US005399476A

United States Patent [19]

Uchida

[11] Patent Number: 5,399,476

[45] Date of Patent: Mar. 21, 1995

[54] SILVER HALIDE PHOTOGRAPHIC EMULSION AND METHOD OF PREPARING THE SAME

[75] Inventor: Mitsuhiro Uchida, Minami-Ashigara, Japan

[73] Assignee: Fuji Photo Film Co., Ltd., Kanagawa, Japan

[21] Appl. No.: 153,170

[22] Filed: Nov. 17, 1993

[30] Foreign Application Priority Data

Dec. 1, 1992 [JP] Japan ..... 4-343645

[51] Int. Cl.[6] ..... G03C 1/035; G03C 1/09

[52] U.S. Cl. ..... 430/567; 430/569; 430/600; 430/605

[58] Field of Search ..... 430/567, 569, 600, 605

[56] References Cited

U.S. PATENT DOCUMENTS

| | | | |
|---|---|---|---|
| 4,463,087 | 7/1984 | Maskasky | 430/567 |
| 4,814,264 | 3/1989 | Kishida et al. | 430/567 |
| 4,997,751 | 3/1991 | Kim | 430/567 |
| 5,238,805 | 8/1993 | Saitou | 430/569 |
| 5,275,930 | 1/1994 | Maskasky | 430/567 |

*Primary Examiner*—Charles L. Bowers, Jr.
*Assistant Examiner*—Mark F. Huff
*Attorney, Agent, or Firm*—Sughrue, Mion, Zinn Macpeak & Seas

[57] ABSTRACT

A silver halide photographic emulsion comprises silver halide grains to which an iridium compound was added during a preparation process. At least 5% by number of said silver halide grains have at least one intrafacial epitaxy limited in the neighborhood of the corners of a major plane of the grain, and the thickness of said epitaxy is 0.1 μm or less.

9 Claims, No Drawings

SILVER HALIDE PHOTOGRAPHIC EMULSION AND METHOD OF PREPARING THE SAME

BACKGROUND OF THE INVENTION

1. Field of the Invention

The present invention relates to a silver halide photographic emulsion and a silver halide photographic light-sensitive material having an excellence in the saving of a silver and an improved reciprocity law failure, with a high sensitivity, an improved graininess, a high color density and a hard gradation.

2. Description of the Related Art

The basic photographic properties that silver halide emulsions are required to have are a high sensitivity, a low fog, and a fine graininess.

various studies have been made to increase the sensitivity of an emulsion. For example, as improvements in grain formation, JP-A-2-943 ("JP-A" means Published Unexamined Japanese Patent Application), JP-A-1-105234, and JP-A-63-285534 disclose methods of improving the halogen structures of silver halides by selecting the conditions of grain formation. As improvements in chemical sensitization, in addition to those in normal gold-sulfur sensitization, methods of improving reduction sensitization are described in, e.g., JP-A-2-222939, JP-A-3-168632, and JP-A-62-291635, and improvements in selenium sensitization are described in, e.g., JP-A-59-185330 and JP-A-3-4221.

Also, attempts to increase sensitivity by performing improvement on the surfaces of silver halide grains have been made.

EP0019917 discloses a method of depositing a silver halide containing less than 10 mol % of iodide on silver halide grains containing 15 to 40 mol % of iodide by epitaxial growth. U.S. Pat. No. 3,782,960 discloses a method of increasing sensitivity by sensitizing silver chlorobromide grains obtained by halide conversion by using 0.01 to 25 mol % of iodide, approximately 0.001 to 1.0 mol % of gold, and an effective amount of silver thiocyanate. In addition, U.S. Pat. No. 4,471,050 discloses a method of epitaxially growing silver thiocyanate or silver cyanate limitedly to the corners or the edges of host grains. In the epitaxial grain obtained by this method, a silver salt having a composition different from that of the surface of a host grain is grown as an epitaxy such that the junction portion is limited to the corner or the edge of the grain. When observed in a direction perpendicular to the major plane of the host grain, this epitaxy extends outside the major plane and is junctioned across a plurality of planes. An epitaxy of this type is low in stability and deforms when left to stand in the form of a solution for several hours. Therefore, such a technique cannot be put into practical use.

In addition, JP-A-62-124552 or JP-A-1-113745 discloses a method of manufacturing ruffle grains having a large number of recesses on their surfaces. These patent applications described that the effect is an improvement in colour sensitization rate due to an increase in surface area.

Furthermore, JP-A-1-273033 discloses a method of junctioning an epitaxy with a low iodide content on the major plane of a host grain containing 5 to 45 mol % of silver iodide. This method can form an intraface epitaxy junctioned to a single major plane. However, the position of this intrafacial epitaxy is not limited in the neighborhood of the corners of the grain, and the host grain has a high iodide content. In addition, since the color density is low, only a soft gradation can be obtained. Hence, the technique is lacking in versatility.

Although various methods have been attempted to increase the sensitivity of a silver halide emulsion as described above, the techniques to increase the sensitivity are still deficient in order to further improve the image quality of a silver halide photographic light-sensitive material. In addition, a strong demand has arisen for a technique of developing an emulsion that can achieve a high color density even with a small amount of silver without impairing the image quality.

Recently, the rate of use of strobe light in photographing using a silver halide photographic light-sensitive material, has been raised, and therefore, there is a demand for an improvement of image quality not only in the case of a regular exposure time of about 1/100 sec, but also in the case of a high illumination intensity exposure in even a shorter exposure time.

In the case where an object having a very low illumination intensity is photographed such as in astronomical photography, the photographing is performed at an exposure time as long as several seconds or more. Therefore, there is proposed a type of photographing material which has a small low illumination intensity failure.

As a technique for improving the reciprocity law for high and low illumination intensity, addition of an iridium compound during the formation of grains, during a chemical sensitization, or after a chemical sensitization is known. However, with such a technique, the improvement of the reciprocity law failure is not sufficient, and the sensitivity in the case of an exposure time of about 1/100 second is lowered.

SUMMARY OF THE INVENTION

The present invention has been made in consideration of the above situation where a technique of obtaining a higher sensitivity and a harder gradation of a silver halide emulsion is desired, and has as its object to develop an entirely new method of sensitizing silver halide emulsions and to thereby provide a silver halide photographic light-sensitive material having an improved reciprocity law failure, with high image qualities and an excellence in the saving of a silver.

The above object of the present invention can be achieved by the following means.

(1) A silver halide photographic emulsion comprising silver halide, to which an iridium compound was added during preparation of the emulsion, wherein at least 5% by number of said silver halide grains have at least one intrafacial epitaxy limited in the neighborhood of the corners of a major plane of the grain, and the thickness of said epitaxy is 0.1 μm or less.

(2) The silver halide photographic emulsion described in item (1) above, wherein the intrafacial epitaxy of each of said silver halide grains is present in a (100) face of the grain.

(3) The silver halide photographic emulsion described in item (1) or (2) above, wherein the silver iodide content of said silver halide grain is less than 5 mol %.

(4) The silver halide photographic emulsion described in item (1) above, wherein the halogen component of each of the silver halide grains and the intrafacial epitaxy is silver bromoiodide containing less than 5 mol % of silver iodide.

(5) A method of preparing the silver halide photographic emulsion described in item (1), wherein the silver halide fine grains are added in the presence of an iridium compound.

DETAILED DESCRIPTION OF THE PREFERRED EMBODIMENTS

The present invention will be described in detail below.

The characteristic features of silver halide grains used in the present invention are that at least 5% by number of the grains have at least one intrafacial epitaxy of the grain, the existence position of said epitaxy is limited in the neighborhood of the corners of a major plane of the grain, and the thickness of said epitaxy is 0.1 μm or less.

The term "epitaxy" used herein means a projection junctioned to a silver halide grain as a host. Although a plurality of epitaxies may exist in one grain, each individual epitaxy is junctioned only to a single major plane. In the present invention, an epitaxy of this type is defined as an "intrafacial epitaxy." That is, the junction condition of epitaxies according to the present invention is not that one epitaxy is junctioned across a plurality of crystal planes at the corner or the edge of a grain, as described in U.S. Pat. No. 4,471,050, but that one epitaxy is junctioned only to a single major plane. A major plane means a plane with the largest specific surface area of all crystal planes of a silver halide grain as a host. That is, in a cubic grain, all six (100) faces are major planes, and, in an octahedral grain, all eight (111) faces are major planes. In the case of a tabular grain having a plurality of twin planes, two (111) faces parallel to these twin planes are major planes. In a tabular grain surrounded by (100) faces as disclosed in JP-A-58-95337, two (100) faces having larger surface areas are major planes. It is preferable that an intraface epitaxy of the present invention be junctioned to a (100) face.

The thickness of an intrafacial epitaxy according to the present invention, measured in a direction perpendicular to a major plane, is 0.01 μm to 0.1 μm, preferably 0.01 μm to 0.08 μm, and more preferably 0.01 μm to 0.05 μm. An intrafacial epitaxy of the present invention preferably has a plate-like shape. A plate-like shape means that the equivalent-circle diameter of the projected area of an intrafacial epitaxy, viewed in a direction perpendicular to a major plane, is twice or more the thickness of the epitaxy.

An intrafacial epitaxy of the present invention may be rounded. That is, when viewed in a parallel direction to a major plane to which an intrafacial epitaxy is junctioned, the thickness of the epitaxy need not be constant; for example, the epitaxy may be constituted by a curved plane whose thickness gradually decreases toward the edge.

In the present invention, the index of plane of a major plane of an intrafacial epitaxy, which is parallel to a major plane, is preferably the same as the index of plane of the major plane. That is, it is preferable that when a major plane is a (100) face, an intrafacial epitaxy have a (100) face, and, when a major plane is a (111) face, an intrafacial epitaxy have a (111) face.

An intrafacial epitaxy of the present invention is junctioned in the neighborhood of the corners of a major plane. A neighborhood of the corners is defined as follows.

First, a point of the center of gravity of a plane of an intrafacial epitaxy, which is parallel to a major plane, is obtained. Assuming that the distance from the point of the center of gravity to the nearest corner is $R_1$, if a relation $R_1<(R_n/2)$ is satisfied for all distances $R_n$ to the other corners, it is defined that this intrafacial epitaxy is present in a portion about the corner. If even only one corner that does not satisfy $R_1<(R_n/2)$ exists except for the corner at the shortest distance, this intrafacial epitaxy does not correspond to an intrafacial epitaxy of the present invention.

In the present invention, the number of intrafacial epitaxies per grain is not particularly limited, and so any number of epitaxies can exist. However, the existence of one epitaxy per grain is sufficient to realize the sensitizing effect of the present invention. The number of intrafacial epitaxies per grain is preferably ten or less, and more preferably five or less.

In the present invention, any number of intrafacial epitaxies may be present on a single major plane. However, in order to realize the sensitizing effect of the present invention efficiently, the number of epitaxies present on one major plane is preferably smaller than that of the corners of the major plane. It is also preferable that epitaxies other than that of the present invention, which do not exist in the neighborhood of the corners, be not present. More preferably, two or less intrafacial epitaxies each limited in the neighborhood of the corners exist on one major plane.

In the present invention, the ratio of the total area of all intrafacial epitaxies junctioned to a single major plane to the area of that major plane is preferably 1% to less than 50%, and more preferably 5% to 25%. The ratio of the area of one intrafacial epitaxy to the area of a major plane is preferably 1% to 25%, and more preferably 5% to 15%.

In the present invention, intrafacial epitaxies can be observed in at least 5% by number, preferably 20% or more, and more preferably 50% to 100% in number of all grains.

In the present invention, the halogen composition of an intrafacial epitaxy is any of silver bromide, silver iodide, and silver chloride, or a combination of two or more types of them, such as silver bromoiodide or silver chlorobromide. Among these halogen compositions, silver bromoiodide is preferable, and silver bromoiodide with a silver iodide content of 5 mol % or less is more preferable.

The halogen composition of an intrafacial epitaxy of the present invention may have any rate of composition to the halogen composition of a silver halide as a host. For example, an epitaxy having exactly the same halogen composition as that of a host may be junctioned, or an epitaxy with an iodide content either higher or lower than that of a host may be junctioned.

An intrafacial epitaxy according to the present invention can be formed by any method. Examples of the formation method are as follows.

1) With adsorbents such as spectral sensitizing dyes present in a silver halide emulsion as a host, conditions such as a pAg, a pH, and a salt concentration are controlled, and aqueous solutions of a water-soluble silver salt and a water-soluble halide salt are added to the silver halide emulsion to form intrafacial epitaxies. Although the addition amount of the adsorbents depends on the grain size, the crystal habit, the shape, and the halogen composition of the silver halide, it normally, preferably ranges from $1\times10^{-6}$ to $3\times10^{-2}$ mol per mol of silver.
2) while conditions such as a pAg, a pH, and a salt concentration are controlled, silver halide fine grains are added to a silver halide emulsion as a host, thereby forming intrafacial epitaxies.

In either method, the grain size, the crystal habit, the shape, and the halogen composition of silver halide grains as host grains determine the pH, the pAg, and the temperature for forming intrafacial epitaxies, the silver amount ratio of a silver halide added to form intrafacial epitaxies to a silver halide as a host, and the presence/absence and the amount of a silver halide solvent. These conditions, therefore, cannot be determined unconditionally. However, in normal silver halide grains constituted by (100) faces and/or (111) faces, consisting of silver bromide or silver bromoiodide, and having an equivalent-sphere diameter of 0.1 μm to 3 μm, it is preferable that the pH be 2 to 9, the pAg be 4 to 10, the temperature be 35° C. to 80° C., and the silver amount ratio of intrafacial epitaxies to the host grains be 0.05% to 5%.

Intrafacial epitaxies can be formed at any point as long as it is after formation of silver halide grains as host grains. For example, after formation of silver halide grains as host grains, intrafacial epitaxies may be formed subsequently or after desalting and before chemical sensitization. Formation of intrafacial epitaxies can also be performed after chemical sensitization.

The silver halide grain as a host usable in the present invention consists of silver bromide, silver chloride, silver chlorobromide, silver iodochloride, silver bromoiodide, and silver bromochloroiodide. Among these salts, silver bromide, silver bromoiodide, and silver bromochloroiodide are most preferable. The silver halide grain may contain another silver salt, such as silver iodide, silver rhodanide, silver sulfide, silver selenide, silver carbonate, silver phosphate, or silver salt of an organic acid, as another grain or as a part of the grain. When rapid processing is required in development and desilvering (bleaching, fixing, and bleach-fixing), a silver halide grain with a high silver chloride content is desirable. To inhibit development appropriately, on the other hand, a grain preferably contains silver iodide.

A preferable silver iodide content changes in accordance with the use of the light-sensitive material. In silver halide emulsions of the present invention, silver halide grains containing less than 5 mol % of silver iodide are preferably used as host grains. The silver iodide content preferably be less than 5 mol % in order to achieve a high sensitivity and a hard gradation while improving image quality, and to save an amount of silver, which are the objects of the present invention. The silver iodide content is more preferably 0.05 mol % to 3 mol %. Silver halide emulsions of the present invention containing silver halide grains with this silver iodide content can be used in any silver halide photographic light-sensitive material, e.g., an X-ray light-sensitive material, a graphic art light-sensitive material, a micro light-sensitive material, a color negative light-sensitive material, and a color reversal light-sensitive material.

All epitaxies in conventional techniques are junctioned by using the composition difference between a silver halide grain as a host and an epitaxy. Examples are a combination of a silver bromide host and a silver chloride epitaxy and a combination of a host with a high-iodide content and an epitaxy with a low-iodide content. Some epitaxies are grown in a specific portion by allowing an adsorbate, such as a sensitizing dye, to be adsorbed to the epitaxies in advance and using the function as a site director (adsorption surface inhibitor) that the adsorbate has. The characteristic features of the present invention are that not only an intrafacial epitaxy limited in the neighborhood of the corners of a major plane is entirely novel but the intrafacial epitaxy requires neither the composition difference between the epitaxy and a host, which is conventionally considered essential for an epitaxy for yielding a sensitizing effect, nor the presence of a site director.

It is most preferable in the present invention that the silver halide grains serving as a host and the epitaxy contain less than 5 mol % of silver iodide.

In the present invention, a silver halide emulsion serving as a host preferably has a distribution or a structure associated with a halogen composition in its grains. A typical example of such a grain is a core-shell or double structure grain, in which the interior and the surface layer of the grain have different halogen compositions, as disclosed in, e.g., JP-B-43-13162 ("JP-B" means Published Examined Japanese Patent Application), JP-A-61-143331, JP-A-60-222845, or JP-A-61-75337. The structure need not be a simple double structure but may be a triple structure or a multiple structure larger than the triple structure as disclosed in JP-A-60-222844. It is also possible to bond a thin silver halide having a different composition from that of any of these grains on the surface of the grain.

In the case of, e.g., a silver bromoiodide grain having any of the above structures, the silver iodide content of the core may be higher than that of the shell. In contrast to this, the silver iodide content of the core may be low while that of the shell is high.

Silver halide grains for use in the emulsions of the present invention can be selected in accordance with the intended use. Examples are a regular crystal not containing a twin plane and crystals explained in Japan Photographic Society ed., The Basis of Photographic Engineering, Silver Salt Photography (CORONA PUBLISHING CO., LTD.), page 163, such as a single twinned crystal containing one twin plane, a parallel multiple twinned crystal containing two or more parallel twin planes, and a nonparallel multiple twinned crystal containing two or more nonparallel twin planes. A method of mixing grains having different shapes is disclosed in U.S. Pat. No. 4,865,964, and so this method can be selected as needed. In the case of a regular crystal, it is possible to use a cubic grain constituted by (100) faces, an octahedral grain constituted by (111) faces, or a dodecahedral grain constituted by (110) faces disclosed in JP-B-55-42737 or JP-A-60-222842. It is also possible to use, in accordance with the intended use of an emulsion, an (h11) face grain represented by a (211) face grain, an (hh1) face grain represented by a (331) face grain, an (hk0) face grain represented by a (210) face grain, or an (hk1) face grain represented by a (321) face grain, as reported in Journal of Imaging Science, Vol. 30, page 247, 1986, although the preparation method requires some improvements. A grain having two or more different faces, such as a tetradecahedral grain having both (100) and (111) faces, a grain having (100) and (110) faces, or a grain having (111) and (110) faces can also be used in accordance with the intended use of an emulsion.

A value obtained by dividing the equivalent-circle diameter of the projected area of a grain by the thickness of the grain is called an aspect ratio which defines the shape of a tabular grain. Tabular grains having aspect ratios higher than 1 can be used in the present invention. Tabular grains can be prepared by the methods described in, e.g., Cleve, Photography Theory and Practice (1930), page 131; Gutoff, Photographic Science and Engineering, Vol. 14, pages 248 to 257, (1970); and U.S. Pat. Nos. 4,434,226, 4,414,310, 4,433,048, and 4,439,520, and British Patent 2,112,157. The use of tabular grains brings about advantages, such as an increase in coating adhesion and an increase in the efficiency of color sensitization due to sensitizing dyes. These advantages are described in detail in U.S. Pat. No. 4,434,226 cited above. An average aspect ratio of 80% or more of the total projected area of grains is preferably 1 to 100 or less, more preferably 2 to 20 or less, and most preferably 3 to 10 or less. The shape of a tabular grain can be selected from, e.g., a triangle, a hexagon, and a circle. An example of a preferable shape is a regular hexagon having six substantially equal sides, as described in U.S. Pat. No. 4,797,354.

The equivalent-circle diameter of the projected area of a grain is often used to represent the grain size of a tabular grain. Grains having an average diameter of 0.6 μm or less, as described in U.S. Pat. No. 4,748,106, are preferable for achieving high image quality. An emulsion having a narrow grain size distribution, as described in U.S. Pat. No. 4,775,617, is also preferable. To increase sharpness, it is preferable to limit the grain thickness of a tabular grain to 0.5 μm or less, more preferably 0.3 μm or less. In addition, an emulsion in which the variation coefficient of grain thickness is 30% or less, i.e., in which the uniformity of thickness is high is also preferable. Furthermore, a grain described in JP-A-63-163451, in which the grain thickness and the distance between twin planes are defined, is preferable.

In the case of a tabular grain or a grain having an equivalent-sphere diameter of 0.5 μm or less, dislocation lines of the grain can be observed by a transmission electron microscope. The silver halide grain as a host of the present invention either may or may not have dislocation lines. Although the sensitizing effect of an intraface epitaxy of the present invention is greater in a grain with a smaller number of dislocation lines, grains may contain dislocation lines in accordance with the intended use.

Dislocation lines can be introduced linearly with respect to a specific direction of a crystal orientation of a grain or curved with respect to that direction. It is also possible to introduce dislocation lines throughout an entire grain or only to a particular portion of a grain, e.g., the fringe portion of a grain. When dislocation lines are limitedly introduced to the fringe portion, dislocation lines of each grain can be counted by observing the grain by using an electron microscope. In the silver halide grains of the present invention, it is preferable that 30 or less, and more preferably 10 or less dislocation lines be observed per grain.

The grain size of a silver halide emulsion used in the present invention can be evaluated in terms of the equivalent-circle diameter of the projected area of a grain, obtained by using an electron microscope, the equivalent-sphere diameter of the volume of a grain, calculated from the projected area and the thickness of the grain, or the equivalent-sphere diameter of the volume of a grain, obtained by a Coulter counter method. It is possible to selectively use various grains from a very fine grain having an equivalent-sphere diameter of 0.05 μm or less to a large grain having that of 10 μm or more. In the case of a silver halide of the present invention, the equivalent-sphere diameter is preferably 0.05 to 2.0 μm, and more preferably 0.05 to 1.0 μm.

A silver halide emulsion of the present invention is a monodisperse silver halide emulsion. "Monodisperse" means that the variation coefficient of the equivalent-sphere diameter of an emulsion is 0.20 or less when observed by an electron microscope. That is, an emulsion in which the value (variation coefficient) of a quotient obtained by dividing a standard deviation s of the distribution of equivalent-sphere diameters by an average equivalent-sphere diameter r is 0.20 or less is the monodisperse emulsion.

In order for a light-sensitive material to satisfy its target gradation, two or more monodisperse silver halide emulsions having different grain sizes and containing at least one silver halide emulsion of the present invention can be mixed in a single emulsion layer having essentially the same color sensitivity or can be coated as different layers. It is also possible to mix two or more types of polydispersed silver halide emulsions or both monodisperse and polydisperse emulsions in a single layer, or to coat them as different layers.

A silver halide emulsion of the present invention contains a dispersion medium. A typical example of the dispersion medium is a hydrophilic protective colloid represented by gelatin.

Photographic emulsions used in a light-sensitive material of the present invention can be prepared by the methods described in, e.g., P. Glafkides, Chimie et Physique Photographique, Paul Montel, 1967; G. F. Duffin, Photographic Emulsion Chemistry, Focal Press, 1966; and V. L. Zelikman et al., Making and Coating Photographic Emulsion, Focal Press, 1964. That is, any of an acid method, a neutral method, and an ammonia method can be used. In forming grains by a reaction of a soluble silver salt and a soluble halogen salt, any of a single-jet method, a double-jet method, and a combination of these methods can be used. It is also possible to use a method (so-called reverse double-jet method) of forming grains in the presence of excess silver ion. As one type of the double-jet method, a method in which the pAg of a liquid phase for producing a silver halide is maintained constant, i.e., a so-called controlled double-jet method can be used. This method makes it possible to obtain a silver halide emulsion in which a crystal shape is regular and a grain size is nearly uniform.

In some cases, it is preferable to make use of a method of adding silver halide grains already formed by precipitation to a reactor vessel for emulsion preparation, and the methods described in U.S. Pat. Nos. 4,334,012, 4,301,241, and 4,150,994. These silver halide grains can be used as seed crystals and are also effective when supplied as a silver halide for growth. In the latter case, addition of an emulsion with a small grain size is preferable. The total amount of an emulsion can be added at one time, or an emulsion can be separately added a plurality of times or added continuously.

A method of converting most of or only a part of the halogen composition of a silver halide grain by a halogen conversion process is disclosed in, e.g., U.S. Pat. Nos. 3,477,852 and 4,142,900, EP 273,429 and EP 273,430, and West German Patent 3,819,241. This method is an effective grain formation method. To convert into a silver salt which can hardly be dissolved, it is possible to add a solution of a soluble halogen salt or silver halide grains. The conversion can be performed at one time, separately a plurality of times, or continuously.

As a grain growth method other than the method of adding a soluble silver salt and a halogen salt at a constant concentration and a constant flow rate, it is preferable to use a grain formation method in which the concentration or the flow rate is changed, such as described in British Patent 1,469,480 and U.S. Pat. Nos. 3,650,757 and 4,242,445. Increasing the concentration or the flow rate can change the amount of a silver halide to be supplied as a linear function, a quadratic function, or a more complex function of the addition time. It is also preferable to decrease the silver halide amount to be supplied if necessary depending on the situation. Furthermore, when a plurality of soluble silver salts of different solution compositions are to be added or a plurality of soluble halogen salts of different solution compositions are to be added, a method of increasing one of the salts while decreasing the other is also effective.

A mixing vessel for reacting solutions of soluble silver salts and soluble halogen salts can be selected from those described in U.S. Pat. Nos. 2,996,287, 3,342,605, 3,415,650, and 3,785,777 and West German Patents 2,556,885 and 2,555,364.

A silver halide solvent is useful for the purpose of accelerating ripening. As an example, it is known to make an excess of halogen ion exist in a reactor vessel in order to accelerate ripening. Another ripening agent can also be used. The total amount of these ripening agents can be mixed in a dispersing medium placed in a reactor vessel before addition of silver and halide salts, or can be introduced to the reactor vessel simultaneously with addition of a halide salt, a silver salt, and a deflocculant. Alternatively, ripening agents can be independently added in the step of adding a halide salt and a silver salt.

Examples of the ripening agent are ammonia, thiocyanate (e.g., potassium rhodanide and ammonium rhodanide), an organic thioether compound (e.g., compounds described in U.S. Pat. Nos. 3,574,628, 3,021,215, 3,057,724, 3,038,805, 4,276,374, 4,297,439, 3,704,130, and 4,782,013 and JP-A-57-104926), a thione compound (e.g., tetra-substituted thioureas described in JP-A-53-82408, JP-A-55-77737, and U.S. Pat. No. 4,221,863, or compounds described in JP-A-53-144319), mercapto compounds capable of accelerating growth of silver halide grains, described in JP-A-57-202531, and an amine compound (e.g., JP-A-54-100717).

It is advantageous to use gelatin as a protective colloid for use in preparation of emulsions of a light-sensitive material of the present invention or as a binder for other hydrophilic colloid layers. However, another hydrophilic colloid can also be used in place of gelatin.

Examples of the hydrophilic colloid are protein, such as a gelatin derivative, a graft polymer of gelatin and another high polymer, albumin, and casein; a cellulose derivative, such as hydroxyethylcellulose, carboxymethylcellulose, and cellulose sulfates; suger denivative, such as soda alginate, and a starch derivative; and a variety of synthetic hydrophilic high polymers, such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinyl pyrazole.

Examples of gelatin are lime-processed gelatin, acid-processed gelatin, and enzyme-processed gelatin described in Bull. Soc. Sci. Photo. Japan. No. 16, page 30 (1966). In addition, a hydrolyzed product or an enzyme-decomposed product of gelatin can also be used.

It is preferable to wash an emulsion for use in a light-sensitive material of the present invention for a desalting purpose and disperse it in a newly prepared protective colloid. Although the temperature of washing can be selected in accordance with the intended use, it is preferably 5° C. to 50° C. Although the pH at washing can also be selected in accordance with the intended use, it is preferably 2 to 10, and more preferably 3 to 8. The pAg at washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

The silver halide emulsion according to the present invention is characterized in that an iridium compound is added during the preparation process. The addition of the iridium compound may be performed anytime of the followings, during the formation of grains, during a water-washing, before a chemical sensitization, during a chemical sensitization, and after a chemical sensitization, but preferably before the formation of the intrafacial epitaxy of the present invention. More preferably, the intrafacial epitaxy should be formed by means of the method 2) in which the silver halide grains are added after the addition of the iridium compound.

Appropriate examples of the iridium compound are a water-soluble iridium salt, and a complex compound. Examples of the preferable iridium compounds are iridium trichloride, iridium tetrachloride, and sodium, potassium, or ammonium hexachloroiridate (III) or (IV).

The amount of the iridium compound used is preferably in the range of $1\times10^{-10}$ mol to $1\times10^{-4}$ mol, and more preferably $1\times10^{-9}$ mol to $1\times10^{-6}$ mol.

It is generally thought that a high illumination intensity reciprocity failure is caused mainly by latent image dispersion due to excessive chemical ripening, and a low illumination intensity reciprocity failure is caused mainly by recombination due to insufficient chemical ripening. In the present invention, as the intrafacial epitaxy and the iridium compound are combined, a remarkable improvement in reciprocity law failure is exhibited. The mechanism for such an improvement is presently researched intensively, but has not yet been completely resolved. It is considered that, in the mechanism, the iridium compound acts in the neighborhood of the intrafacial epitaxy limited to the corners of a major plane of the grain so as to prevent the latent image dispersion and recombination.

In the preparation of an emulsion used in a light-sensitive material the present invention, it is preferable to make salt of metal ion exist during grain formation, desalting, or chemical sensitization, or before coating in accordance with the intended use. The metal ion salt is preferably added during grain formation in performing doping for grains, and after grain formation and before completion of chemical sensitization in modifying the grain surface or when used as a chemical sensitizer. The doping can be performed for any of an overall grain, only the core, the shell, or the epitaxy portion of a grain, and only a substrate grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of a salt that can be dissolved during grain formation, such as ammonium salt, acetate, nitrate, sulfate, phosphate, hydroxide, salt, 6-coordinated complex salt, or 4-coordinated complex salt. Examples are $CdBr_2$, $CdCl_2$, $Cd(NO3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and K4Ru(CN)6. The ligand of a coordination compound can be selected from halo, aquo, cyano, cyanate, thiocyanate, nitrosyl, thionitrosyl, oxo, and carbonyl. These metal compounds can be used either singly or in a combination of two or more types of them.

The metal compounds are preferably dissolved in an appropriate solvent, such as methanol or acetone, and added in the form of a solution. To stabilize the solution, an aqueous hydrogen halide solution (e.g., HCl and HBr) or an alkali halide (e.g., KCl, NaCl, KBr, and NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, and KI) and added in the form of a solution continuously during formation of silver halide grains. Furthermore, a solution of the metal compounds can be prepared independently of a water-soluble salt or an alkali halide and added continuously at a proper timing during grain formation. It is also possible to combine several different addition methods.

It is sometimes useful to perform a method of adding a chalcogen compound during preparation of an emulsion, such as described in U.S. Pat. No. 3,772,031. In addition to S, Se, and Te, cyanate, thiocyanate, selenocyanic acid, carbonate, phosphate, and acetate can be present.

In formation of silver halide grains of the present invention, at least one of sulfur sensitization, selenium sensitization, noble metal sensitization (e.g., gold sensitization and palladium sensitization), and reduction sensitization can be performed at any point during the process of manufacturing a silver halide emulsion. The use of two or more different sensitizing methods is preferable. Several different types of emulsions can be prepared by changing the timing at which the chemical sensitization is performed. The emulsion types are classified into: a type in which a chemical sensitization speck is embedded inside a grain, a type in which it is embedded at a shallow position from the surface of a grain, and a type in which it is formed on the surface of a grain. In emulsions of the present invention, the location of a chemical sensitization speck can be selected in accordance with the intended use. It is, however, generally preferable to form at least one type of a chemical sensitization speck near the surface.

One chemical sensitization which can be preferably performed in the present invention is chalcogen sensitization, noble metal sensitization, or a combination of these. The sensitization can be performed by using an active gelation as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferable. In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, i.e., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457.

It is preferable to also perform gold sensitization for a silver halide emulsion of the present invention. An amount of a gold sensitizer is preferably $1\times10^{-4}$ to $1\times10^{-7}$ mole, and more preferably $1\times10^{-5}$ to $5\times10^{-7}$ mole. A preferable amount of a palladium compound is $1\times10^{-3}$ to $5\times10^{-7}$. A preferable amount of a thiocyan compound or a selenocyan compound is $5\times10^{-2}$ to $1\times10^{-6}$.

An amount of a sulfur sensitizer with respect to silver halide grains of the present invention is preferably $1\times10^{-4}$ to $1\times10^{-7}$ mole, and more preferably $1\times10^{-5}$ to $5\times10^{-7}$ mole per mole of a silver halide.

Selenium sensitization is a preferable sensitizing method for a silver halide emulsion of the present invention. Known unstable selenium compounds are used in the selenium sensitization. Practical examples of the selenium compound are colloidal metal selenium, selenoureas (e.g., N,N-dimethylselenourea and N,N-diethylselenourea), selenoketones, and selenoamides. In some cases, it is preferable to perform the selenium sensitization in combination with one or both of the sulfur sensitization and the noble metal sensitization.

The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

Silver halide emulsion of the present invention are preferably subjected to reduction sensitization during grain formation.

The reduction sensitization can be selected from a method of adding reduction sensitizers to a silver halide emulsion, a method called silver ripening in which grains are grown or ripened in a low-pAg environment at pAg 1 to 7, and a method called high-pH ripening in which grains are grown or ripened in a high-pH environment at pH 8 to 11. It is also possible to perform two or more of these methods together.

The method of adding reduction sensitizers is preferable in that the level of reduction sensitization can be finely adjusted.

Known examples of the reduction sensitizer are stannous chloride, ascorbic acid and its derivative, amines and polyamines, a hydrazine derivative, formamidinesulfinic acid, a silane compound, and a borane compound. In the reduction sensitization of the present invention, it is possible to selectively use these known reduction sensitizers or to use two or more types of compounds together. Preferable compounds as the reduction sensitizer are stannous chloride, thiourea dioxide, dimethylamineborane, and ascorbic acid and its derivative. Although an addition amount of the reduction sensitizers must be so selected as to meet the emulsion manufacturing conditions, a preferable amount is $10^{-7}$ to $10^{-3}$ mole per mole of a silver halide.

The reduction sensitizers are dissolved in water or an organic solvent, such as alcohols, glycols, ketones, esters, or amides, and the resultant solution is added during grain growth. Although adding to a reactor vessel in advance is also preferable, adding at a given timing during grain growth is more preferable. It is also possible to add the reduction sensitizers to an aqueous solution of a water-soluble silver salt or a water-soluble alkali halide to precipitate silver halide grains by using this aqueous solution. Alternatively, a solution of the reduction sensitizers may be added separately several times or continuously over a long time period with grain growth.

It is preferable to use an oxidizer for silver during the process of manufacturing emulsions for use in a light-sensitive material of the present invention. The oxidizer for silver means a compound having an effect of converting metal silver into silver ion. A particularly effective compound is the one that converts very fine silver grains, as a by-product in the process of formation of silver halide grains and chemical sensitization, into silver ion. The silver ion produced may form a silver salt hard to dissolve in water, such as a silver halide, silver sulfide, or silver selenide, or a silver salt easy to dissolve in water, such as silver nitrate. The oxidizer for silver may be either an inorganic or organic substance. Examples of the inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2].6H_2O$), permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of the organic oxidizer are quinones (e.g., p-quinone), an organic peroxide (e.g., peracetic acid and perbenzoic acid), and a compound for releasing active halogen (e.g., N-bromosuccinimide, chloramine T, and chloramine B).

Preferable oxidizers of the present invention are an inorganic oxidizer such as ozone, hydrogen peroxide and its adduct, a halogen element, or a thiosulfonate, and an organic oxidizer such as quinones. A combination of the reduction sensitization described above and the oxidizer for silver is preferable. In this case, the reduction sensitization may be performed after the oxidizer is used or vice versa, or the reduction sensitization and the use of the oxidizer may be performed at the same time. These methods can be performed during grain formation or chemical sensitization.

Photographic emulsions used in a light-sensitive material of the present invention may contain various compounds in order to prevent fog during the manufacturing process, storage, or photographic treatments of a light-sensitive material, or to stabilize photographic properties. Usable compounds are those known as an antifoggant or a stabilizer, for example, thiazoles, such as benzothiazolium salt, nitroimidazoles, nitrobenzimidazoles, chlorobenzimidazoles, bromobenzimidazoles, mercaptothiazoles, mercaptobenzothiazoles, mecaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindenes, such as triazaindenes, tetrazaindenes (particularly hydroxy-substituted(1,3,3a,7)-tetrazaindenes), and pentazaindenes. For example, compounds described in U.S. Pat. Nos. 3,954,474 and 3,982,947 and JP-B-52-28660 can be used. One preferable compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and the stabilizers can be added during preparation of an emulsion to achieve their original fog preventing effect and stabilizing effect. In addition, the antifoggants and the stabilizers can be used for various purposes of, e.g., controlling crystal habit of grains, decreasing a grain size, decreasing the solubility of grains, controlling chemical sensitization, and controlling an arrangement of dyes.

Silver halide photographic emulsion of the present invention are preferably subjected to spectral sensitization by methine dyes and the like in order to achieve the effects of the present invention. Usable dyes involve a cyanine dye, a merocyanine dye, a composite cyanine dye, a composite merocyanine dye, a holopolar cyanine dye, a hemicyanine dye, a styryl dye, and a hemioxonole dye. Most useful dyes are those belonging to a cyanine dye, a merocyanine dye, and a composite merocyanine dye. Any nucleus commonly used as a basic heterocyclic nucleus in cyanine dyes can be contained in these dyes. Examples of a nucleus are a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus, and a pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, a benzindolenine nucleus, an indole nucleus, a benzoxadole nucleus, a naphthoxazole nucleus, a benzthiazole nucleus, a naphthothiazole nucleus, a benzoselenazole nucleus, a benzimidazole nucleus, and a quinoline nucleus. These nuclei may be substituted on a carbon atom.

It is possible to apply to a merocyanine dye or a composite merocyanine dye a 5- or 6-membered heterocyclic nucleus as a nucleus having a ketomethylene structure. Examples are a pyrazoline-5-one nucleus, a thiohydantoin nucleus, a 2-thiooxazolidine-2,4-dione nucleus, a thiazolidine-2,4-dione nucleus, a rhodanine nucleus, and a thiobarbituric acid nucleus.

Although these sensitizing dyes may be used singly, they can also be used together. The combination of sensitizing dyes is often used for a supersensitization purpose. Representative examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents 1,344,281 and 1,507,803, JP-B-43-4936, JP-B-53-12375, JP-A-52-110618, and JP-A-52-109925.

Emulsion of the present invention may contain, in addition to the sensitizing dyes, dyes having no spectral sensitizing effect or substances not essentially absorbing visible light and presenting supersensitization.

The sensitizing dyes can be added to an emulsion at any point in preparation of an emulsion, which is conventionally known to be useful. Most ordinarily, the addition is performed after completion of chemical sensitization and before coating. However, it is possible to perform the addition at the same timing as addition of chemical sensitizing dyes to perform spectral sensitization and chemical sensitization simultaneously, as described in U.S. Pat. Nos. 3,628,969 and 4,225,666. It is also possible to perform the addition prior to chemical sensitization, as described in JP-A-58-113928, or before completion of formation of a silver halide grain precipitation to start spectral sensitization. Alternatively, as disclosed in U.S. Pat. No. 4,225,666, these compounds can be added separately; a portion of the compounds may be added prior to chemical sensitization, while the remaining portion is added after that. That is, the compounds can be added at any time during formation of silver halide grains, including the method disclosed in U.S. Pat. No. 4,183,756.

The addition amount may be $4\times10^{-6}$ to $8\times10^{-3}$ mole per mole of a silver halide. However, for a more preferable silver halide grain size of 0.2 to 1.2 μm, an addition amount of about $5\times10^{-5}$ to $2\times10^{-3}$ mole per mole of a silver halide is more effective.

Although the several different additives described above can be used in the light-sensitive material according to the present invention, a variety of other additives can also be used in accordance with the intended use.

The details of these additives are described in Research Disclosures Item 17643 (December, 1978), R.D. Item 18716 (November, 1979), and R.D. Item 308119 (December, 1989), and these portions are summarized in a table below.

| Additives | RD17643 | RD18716 | RD308119 |
|---|---|---|---|
| 1. Chemical sensitizers | page 23 | page 648, right column | page 996 |
| 2. Sensitivity increasing agents | | page 648, right column | |
| 3. Spectral sensitizers, super sensitizers | pages 23–24 | page 648, right column to page 649, right column | page 996, right column to page 998, right column |
| 4. Brighteners | page 24 | page 648, right column | page 998, right column |
| 5. Antifoggants, stabilizers | pages 24–25 | page 649, right column | page 998, right column to page 1,000, right column |
| 6. Light absorbent, filter dye, ultraviolet absorbents | pages 25–26 | page 649, right column to page 650, left column | page 1,003, left column to page 1,003, right columns |
| 7. Stain-preventing agents | page 25, right column | page 650, left to right columns | page 1,002, right column |
| 8. Dye image-stabilizer | page 25 | page 650, left column | page 1,002, right column |
| 9. Hardening agents | page 26 | page 651, left column | page 1,004, right column to page 1,005, left column |
| 10. Binder | page 26 | page 651, left column | page 1,003, right column to page 1,004, right column |
| 11. Plasticizers, lubricants | page 27 | page 650, right column | page 1,006, left column to page 1,006, right columns |
| 12. Coating aids, surface active agents | pages 26–27 | page 650, right column | page 1,005, left column to page 1,006, left column |
| 13. Antistatic agents | page 27 | page 650, right column | page 1,006, right column to page 1,007, left column |

The light-sensitive material of the present invention needs only to have at least one of silver halide emulsion layers, i.e., a blue-sensitive layer, a green-sensitive layer, and a red-sensitive layer, formed on a support. The number or order of the silver halide emulsion layers and the non-light-sensitive layers are particularly not limited. A typical example is a silver halide photographic light-sensitive material having, on a support, at least one unit light-sensitive layer constituted by a plurality of silver halide emulsion layers which are sensitive to essentially the same color but have different sensitivities or speeds. The unit light-sensitive layer is sensitive to blue, green or red light. In a multi-layered silver halide color photographic light-sensitive material, the unit light-sensitive layers are generally arranged such that red-, green-, and blue-sensitive layers are formed from a support side in the order named. However, this order may be reversed or a layer having a different color sensitivity may be sandwiched between layers having the same color sensitivity in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-speed emulsion layers can be preferably used as described in West German Patent 1,121,470 or British Patent 923,045. In this case, layers are preferably arranged such that the sensitivity or speed is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-speed emulsion layer is formed remotely from a support and a high-speed layer is formed close to the support.

More specifically, layers may be arranged from the farthest side from a support in an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-B-56-25738 and JP-B-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an intermediate layer, and a silver halide emulsion layer having sensitivity lower than that of the intermediate layer is arranged as a lower layer. In other words, three layers having different sensitivities may be arranged such that the sensitivity is sequentially decreased toward the support. When a layer structure is constituted by three layers having different sensitivities or speeds, these layers may be arranged in an order of medium-speed emulsion layer/high-speed emulsion layer/low-speed emulsion layer from the farthest side from a support in a layer having the same color sensitivity as described in JP-A-59-202464.

Also, an order of high-speed emulsion layer/low-speed emulsion layer/medium-speed emulsion layer, or low-speed emulsion layer/medium-speed emulsion layer/high-speed emulsion layer may be adopted.

Furthermore, the arrangement can be changed as described above even when four or more layers are formed.

As described above, various layer configurations and arrangements can be selected in accordance with the application of the light-sensitive material.

In the present invention, a non-light-sensitive fine grain silver halide is preferably used. The non-light-sensitive fine grain silver halide means silver halide fine grains not sensitive upon imagewise exposure for obtaining a dye image and essentially not developed in development. The non-light-sensitive fine grain silver halide is preferably not fogged beforehand.

The fine grain silver halide contains 0 to 100 mol % of silver bromide and may contain silver chloride and/or silver iodide as needed. Preferably, the fine grain silver halide contains 0.5 to 10 mol % of silver iodide.

An average grain size (an average value of equivalent-circle diameters of projected areas) of the fine grain silver halide is preferably 0.01 to 0.5 μm, and more preferably, 0.02 to 0.2 μm.

The fine grain silver halide can be prepared by a method similar to a method of preparing normal light-sensitive silver halide. In this preparation, the surface of a silver halide grain need not be subjected to either chemical sensitization or spectral sensitization. However, before the silver halide grains are added to a coating solution, a known stabilizer such as a triazole compound, an azaindene compound, a benzothiazolium compound, a mercapto compound, or a zinc compound is preferably added. This fine grain silver halide grain-containing layer preferably contains colloidal silver.

A coating silver amount of the light-sensitive material of the present invention is preferably 6.0 g/m$^2$ or less, and most preferably, 4.5 g/m$^2$ or less.

The silver halide emulsion of the present invention may be used in any of the layers of the light-sensitive material. In particular, the silver halide emulsion is used for improving the reciprocity law failure and the like; therefore it is preferable that the emulsion be used in the red-sensitive layer and/or the green-sensitive layer, the sensitivity of each of which is low in relative to other layers in the case where the light source having a high color temperature and a high illumination intensity, such as strobe light is used.

In the present invention, the amount of silver halide emulsion used in each of the color-sensitive layers can be arbitrarily exchanged. The amount of the silver halide emulsion may be changed in accordance with the type of a light-sensitive material, and purpose.

In order to prevent degradation in photographic properties caused by formaldehyde gas, a compound described in U.S. Pat. Nos. 4,411,987 or 4,435,503, which can react with formaldehyde and fix the same, is preferably added to the light-sensitive material.

The light-sensitive material of the present invention preferably contains a mercapto compound described in U.S. Pat. Nos. 4,740,454 and 4,788,132, JP-A-62-18539, and JP-A-1-283551.

The light-sensitive material of the present invention preferably contains compounds which release, regardless of a developed silver amount produced by the development, a fogging agent, a development accelerator, a silver halide solvent, or precursors thereof, described in JP-A-1-106052.

The light-sensitive material of the present invention preferably contains dyes dispersed by methods described in International Disclosure WO 88/04794 and JP-A-1-502912 or dyes described in European Patent 317,308A, U.S. Pat. No. 4,420,555, and JP-A-1-259358.

Various color couplers can be used in the present invention, and specific examples of these couplers are described in patents described in the above-mentioned RD No. 17643, VII-C to VII-G and RD No. 307105, VII-C to VII-G.

Preferable examples of yellow couplers are described in, e.g., U.S. Pat. Nos. 3,933,501; 4,022,620; 4,326,024;

4,401,752 and 4,248,961, JP-B-58-10739, British Patents 1,425,020 and 1,476,760, U.S. Pat. Nos. 3,973,968; 4,314,023 and 4,511,649, and European Patent 249,473A.

Examples of a magenta coupler are preferably 5-pyrazolone type and pyrazoloazole type compounds, and more preferably, compounds described in, for example, U.S. Pat. Nos. 4,310,619 and 4,351,897, European Patent 73,636, U.S. Pat. Nos. 3,061,432 and 3,725,067, RD No. 24220 (June 1984), JP-A-60-33552, RD No. 24230 (June 1984), JP-A-60-43659, JP-A-61-72238, JP-A-60-35730, JP-A-55-118034, JP-A-60-18951, U.S. Pat. Nos. 4,500,630; 4,540,654 and 4,556,630, and WO No. 88/04795.

Examples of a cyan coupler are phenol type and naphthol type ones. Of these, preferable are those described in, for example, U.S. Pat. Nos. 4,052,212; 4,146,396; 4,228,233; 4,296,200; 2,369,929; 2,801,171; 2,772,162; 2,895,826; 3,772,002; 3,758,308; 4,343,011 and 4,327,173, West German Patent Laid-open Application 3,329,729, European Patents 121,365A and 249,453A, U.S. Pat. Nos. 3,446,622; 4,333,999; 4,775,616; 4,451,559; 4,427,767; 4,690,889; 4,254,212 and 4,296,199, and JP-A-61-42658. Also, the pyrazoloazole type couplers disclosed in JP-A-64-553, JP-A-64-554, JP-A-64-555 and JP-A-64-556, and imidazole type couplers disclosed in U.S. Pat. No. 4,818,672 can be used as cyan coupler in the present invention. Typical examples of a polymerized dye-forming coupler are described in, e.g., U.S. Pat. Nos. 3,451,820; 4,080,211; 4,367,282; 4,409,320 and 4,576,910, British Patent 2,102,173, and European Patent 341,188A.

Preferable examples of a coupler capable of forming colored dyes having proper diffusibility are those described in U.S. Pat. No. 4,366,237, British Patent 2,125,570, European Patent 96,570, and West German Laid-open Patent Application No. 3,234,533.

Preferable examples of a colored coupler for correcting unnecessary absorption of a colored dye are those described in RD No. 17643, VII-G, RD No. 30715, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Those compounds which release a photographically useful residue upon coupling may also be preferably used in the present invention. DIR couplers, i.e., couplers releasing a development inhibitor, are preferably those described in the patents cited in the above-described RD No. 17643, VII-F and RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Preferable examples of a coupler which imagewise releases a nucleating agent or a development accelerator are preferably those described in British Patents 2,097,140 and 2,131,188, JP-A-59-157638, and JP-A-59-170840. In addition, compounds releasing, e.g., a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be preferably used.

Examples of other compounds which can be used in the light-sensitive material of the present invention are competing couplers described in, for example, U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, for example, JP-A-60-185950 and JP-A-62-24252; couplers releasing a dye which restores color after being released described in European Patent 173,302A and 313,308A; a ligand releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

The couplers for use in this invention can be introduced into the light-sensitive material by various known dispersion methods.

Examples of a high-boiling point organic solvent to be used in the oil-in-water dispersion method are described in, e.g., U.S. Pat. No. 2,322,027.

Examples of a high-boiling point organic solvent to be used in the oil-in-water dispersion method and having a boiling point of 175° C. or more at atmospheric pressure are phthalic esters (e.g., dibutylphthalate, dicyclohexylphthalate, di-2-ethylhexylphthalate, decylphthalate, bis(2,4-di-t-amylphenyl) phthalate, bis(2,4-di-t-amylphenyl) isophthalate, bis(1,1-di-ethylpropyl) phthalate), phosphate or phosphonate esters (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoate esters (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearyl alcohol and 2,4-di-tert-amylphenol), aliphatic carboxylate esters (e.g., bis(2-ethylhexyl) sebacate, dioctylazelate, glyceroltributyrate, isostearyllactate, and trioctylcitrate), an aniline derivative (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as an auxiliary solvent. Typical examples of the auxiliary solvent are ethyl acetate, butyl acetate, ethyl propionate, methylethylketone, cyclohexanone, 2-ethoxyethylacetate, and dimethylformamide.

Steps and effects of a latex dispersion method and examples of a immersing latex are described in, e.g., U.S. Pat. No. 4,199,363 and German Laid-open Patent Application (OLS) Nos. 2,541,274 and 2,541,230.

Various types of antiseptics and fungicides agent are preferably added to the color light-sensitive material of the present invention. Typical examples of the antiseptics and the fungicides are phenethyl alcohol, and 1,2-benzisothiazolin-3-one, n-butyl p-hydroxybenzoate, phenol, 4-chloro-3,5-dimethylphenol, 2-phenoxyethanol, and 2-(4-thiazolyl)benzimidazole, which are described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, a color paper, a color positive film, and a color reversal paper.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the sum total of film thicknesses of all hydrophilic colloidal layers at the side having emulsion layers is preferably 28 μm or less, more preferably, 23 μm or less, much more preferably, 18 μm or less, and most preferably, 16 μm or less. A film swell speed $T_{\frac{1}{2}}$ is preferably 30 seconds or less, and more preferably, 20 seconds or less. The film thickness means a film thickness measured under moisture conditioning at a temperature of 25° C. and a relative humidity of 55% (two days). The film swell speed $T_{\frac{1}{2}}$ can be measured in accordance with a known method in the art. For example, the film swell speed $T_{\frac{1}{2}}$ can be measured by using a swello-meter described by A. Green et al. in Photographic Science & Engineering, Vol. 19, No. 2, pp. 124 to 129. When 90% of a maximum swell film thickness reached by performing a treatment by using a color developer at 30° C. for 3 minutes and 15 seconds is defined as a saturated film thickness, $T_{\frac{1}{2}}$ is defined as a time required for reaching ½ of the saturated film thickness.

The film swell speed $T_{\frac{1}{2}}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation:

(maximum swell film thickness − film thickness)/film thickness.

In the light-sensitive material of the present invention, a hydrophilic colloid layer (called back layer) having a total dried film thickness of 2 to 20 μm is preferably formed on the side opposite to the side having emulsion layers. The back layer preferably contains, e.g., the light absorbent, the filter dye, the ultraviolet absorbent, the antistatic agent, the film hardener, the binder, the plasticizer, the lubricant, the coating aid, and the surfactant, described above. The swell ratio of the back layer is preferably 150% to 500%.

The color photographic light-sensitive material according to the present invention can be developed by conventional methods described in RD. No. 17643, pp. 28 and 29, RD. No. 18716, the left to right columns, page 651, and RD. No. 307105, pp. 880 and 881.

A color developer used in development of the light-sensitive material of the present invention is an aqueous alkaline solution containing as a main component, preferably, an aromatic primary amine color developing agent. As the color developing agent, although an aminophenol compound is effective, a p-phenylenediamine compound is preferably used. Typical examples of the p-phenylenediamine compound are: 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfates, hydrochlorides and p-toluenesulfonates thereof. Of these compounds, 3-methyl-4-amino-N-ethyl-N-β-hydroxyethylaniline, is preferred in particular. The above compounds can be used in a combination of two or more thereof in accordance with the application.

In general, the color developer contains a pH buffering agent such as a carbonate, a borate or a phosphate of an alkali metal, and a development restrainer or an antifoggant such as a chloride, a bromide, an iodide, a benzimidazole, a benzothiazole, or a mercapto compound. If necessary, the color developer may also contain a preservative such as hydroxylamine, diethylhydroxylamine, a sulfite, a hydrazine such as N,N-biscarboxymethylhydrazine, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye-forming coupler; a competing coupler; an auxiliary developing agent such as 1-phenyl-3-pyrazolidone; a viscosity-imparting agent; and a chelating agent such as an aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof.

In order to perform reversal development, black-and-white development is performed and then color development is performed. As a black-and-white developer, a well-known black-and-white developing agent, e.g., a dihydroxybenzene such as hydroquinone, a 3-pyrazolidone such as 1-phenyl-3-pyrazolidone, and an aminophenol such as N-methyl-p-aminophenol can be used singly or in a combination of two or more thereof.

The pH of the color and black-and-white developers is generally 9 to 12. Although the quantity of replenisher of the developers depends on a color photographic light-sensitive material to be processed, it is generally 3 liters or less per $m^2$ of the light-sensitive material. The quantity of replenisher can be decreased to be 500 ml or less by decreasing a bromide ion concentration in a replenisher. When the quantity of the replenisher is decreased, a contact area of a processing tank with air is preferably decreased to prevent evaporation and oxidation of the solution upon contact with air.

The contact area of the processing solution with air in a processing tank can be represented by an aperture defined below:

Aperture = {contact area ($cm^2$) of processing solution with air}/{volume ($cm^3$) of the solution}

The above aperture is preferably 0.1 or less, and more preferably, 0.001 to 0.05. In order to reduce the aperture, a shielding member such as a floating cover may be provided on the surface of the photographic processing solution in the processing tank. In addition, a method of using a movable cover described in JP-A-1-82033 or a slit developing method described in JP-A-63-216050 may be used. The aperture is preferably reduced not only in color and black-and-white development steps but also in all subsequent steps, e.g., bleaching, bleach-fixing, fixing, washing, and stabilizing steps. In addition, the quantity of replenisher can be reduced by using a means of suppressing storage of bromide ions in the developing solution.

A color development time is normally 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are compounds of a polyvalent metal, e.g., iron (III); peracids; quinones; and nitro compounds. Typical examples of the bleaching agent are an organic complex salt of iron (III), e.g., a complex salt with an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid; or a complex salt with citric acid, tartaric acid, or malic acid. Of these compounds, an iron (III) complex salt of an aminopolycarboxylic acid such as an iron (III) complex salt of ethylenediaminetetraacetic acid or 1,3-diaminopropanetetraacetic acid is preferred because it can increase a processing speed and prevent an environmental contamination. The iron (III) complex salt of an aminopolycarboxylic acid is useful in both the bleaching and bleach-fixing solutions. The pH of the bleaching or bleach-fixing solution using the iron (III) complex salt of an aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Examples of a useful bleaching accelerator are: compounds having a mercapto group or a disulfide group described in, for example, U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and RD No. 17129 (July, 1978); thiazolidine derivatives described in JP-A-50-140129; thiourea derivatives described in JP-B-45-8506, JP-A-52-20832, JP-A-53-32735, and U.S. Pat. No. 3,706,561; iodide salts described in West German Patent 1,127,715 and JP-A-58-16235; polyoxyethylene compounds described in West German Patents 966,410 and 2,748,430; polyamine compounds described in JP-B-45-8836; compounds described in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, e.g., acetic acid, propionic acid, or hydroxy acetic acid.

Examples of the fixing agent used in the fixing solution or the bleach-fixing solution are a thiosulfate salt, a thiocyanate salt, a thioether-based compound, a thiourea and a large amount of an iodide. Of these compounds, a thiosulfate, especially, ammonium thiosulfate, can be used in the widest range of applications. In addition, a combination of a thiosulfate with a thiocyanate, a thioether-based compound or thiourea is preferably used. As a preservative of the fixing solution or the bleach-fixing solution, a sulfite, a bisulfite, a carbonyl bisulfite adduct, or a sulfinic acid compound described in European Patent 294,769A is preferred. Further, in order to stabilize the fixing solution or the bleach-fixing solution, various types of aminopolycarboxylic acids or organic phosphonic acids are preferably added to the solution.

In the present invention, 0.1 to 10 moles, per liter, of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering defect occurs. A preferable time is one to three minutes, and more preferably, one to two minutes. A processing temperature is 25° C. to 50° C., and preferably, 35° C. to 45° C. Within the preferable temperature range, a desilvering speed is increased, and generation of a stain after the processing can be effectively prevented.

In the desilvering step, stirring is preferably as strong as possible. Examples of a method of intensifying the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyer means described in JP-A-60-191257, JP-A-60-191258, or JP-A-60-191259. As described in JP-A-60-191257, this conveyer means can significantly reduce carry-over of a processing solution from a pre-bath to a post-bath, thereby effectively preventing degradation in performance of the processing solution. This effect significantly shortens especially a processing time in each processing step and reduces the quantity of replenisher of a processing solution.

The photographic light-sensitive material of the present invention is normally subjected to washing and/or stabilizing steps after desilvering. An amount of water used in the washing step can be arbitrarily determined over a broad range in accordance with the properties (e.g., a property determined by the substances used, such as a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248–253 (May, 1955).

In the multi-stage counter-current scheme disclosed in this reference, the amount of water used for washing can be greatly decreased. Since washing water stays in the tanks for a long period of time, however, bacteria multiply and floating substances may be adversely attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and a cyabendazole described in JP-A-57-8542, a chlorine-based germicide such as chlorinated sodium isocyanurate, and germicides such as benzotriazole, described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bobai Gakkai ed., "Dictionary of Antibacterial and Antifungal Agents", (1986), can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of water-washing. All known methods described in JP-A-57-8543, JP-A-58-14834, and JP-A-60-220345 can be used in such stabilizing processing.

In some cases, stabilizing is performed subsequently to washing. An example is a stabilizing bath containing a dye stabilizing agent and a surface-active agent to be used as a final bath of the photographic color light-sensitive material. Examples of the dye stabilizing agent are an aldehyde such as formalin or glutaraldehyde, an N-methylol compound, hexamethylenetetramine, and an adduct of aldehyde sulfite.

various chelating agents and fungicides can be added to the stabilizing bath.

An overflow solution produced upon washing and/or replenishment of the stabilizing solution can be reused in another step such as a desilvering step.

In the processing using an automatic developing machine or the like, if each processing solution described above is concentrated by evaporation, water is preferably added to correct the concentration.

The silver halide color light-sensitive material of the present invention may contain a color developing agent in order to simplify processing and increases a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and RD Nos. 14850 and 15159, an aldol compound described in RD No. 13924, a metal salt complex described in U.S. Pat. No. 3,719,492, and a urethane-based compound described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

Further, the silver halide light-sensitive material of the present invention can be applied also to a heat-developing light-sensitive material as disclosed in, e.g., U.S. Pat. No. 4,500,626, JP-A-60-133449, JP-A-59-218443, JP-A-61-238056, and European Patent 210,660A2.

The silver halide color light-sensitive material of the present invention exerts its advantages more effectively when applied to a film unit equipped with a lens disclosed in JP-B-2-32615 or Examined Published Japanese Utility Model Application (JU-B) 3-39782.

The present invention will be described in greater detail below by way of its examples, but the present invention is not limited to these examples.

EXAMPLES

Example 1

The effect that an intrafacial epitaxy of the present invention has on photographic properties and the crystal habit dependency of an intrafacial epitaxy will be described.

<Preparation of emulsion Em-1A>

An aqueous silver nitrate solution and an aqueous solution mixture of potassium bromide and potassium iodide were added to an aqueous gelatin solution of pH 6 at a temperature of 76° C. by a controlled double-jet method of pAg 7.0. This addition was divisionally performed by three stages, the first stage for 10 minutes, the second stage for 30 minutes, and the third stage for 20 minutes. 10 g, 100 g, and 120 g of silver nitrate were consumed in the first, second, and third stages, respectively. The iodide content of the halide solution was 0 mol %, 1 mol %, and 2 mol % in the first, second, and third stages, respectively, and the average iodide content of grains was 1.48 mol %. After the third stage, $6.8\times10^{-4}$ mol, $2.0\times10^{-4}$ mol, and $1.5\times10^{-5}$ mol of sensitizing dyes 1-1, 1-2, and 1-3, respectively, were added to the resultant emulsion, and the emulsion was ripened for 10 minutes.

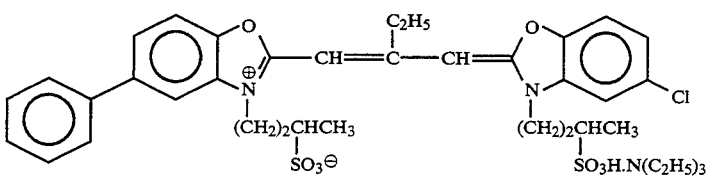

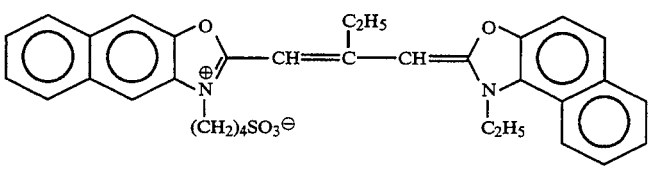

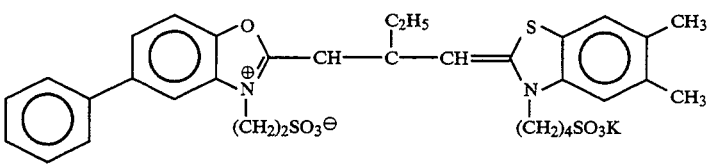

The emulsion was then subjected to a normal desalting step and redispersed at 50° C., pAg 9.0, and pH 6.4. The obtained emulsion consisted of a cubic emulsion with an equivalent-sphere diameter of 0.50 fm and a dispersion coefficient of 8%. This emulsion was labeled Em-1A.

<Preparation of emulsion Em-1B>

In a manner similar to the preparation of the emulsion Em-1A, except that potassium hexachloroiridate was added in amount of $6.4\times10^{-7}$ per mol of silver nitrate 5 minutes before the end of the addition in the third step, a cubic emulsion was prepared. The emulsion was labeled Em-1B.

<Preparation of emulsion Em-1C>

In the preparation of the emulsion Em-1A, the pAg and pH were controlled to 8.0 and 5.4, respectively, 10 minutes after the addition of the sensitizing dyes, and 100 cc of an aqueous solution of 0.3 mol silver nitrate and 100 cc of an aqueous solution of 0.3 mol potassium bromide were added over one minute. Thereafter, following the same procedures as for the emulsion Em-1A, the resultant emulsion was subjected to the desalting step and redispersed at 50° C., pAg 9.0, and pH 6.4. The obtained emulsion consisted of a cubic emulsion with an equivalent-sphere diameter of 0.5 μm and a dispersion coefficient of 8%. This emulsion was labeled Em-1B. In the emulsion Em-1B, a rectangular intrafacial epitaxy junctioned in the neighborhood of the corners of a single (100) face was observed in 54% by number of grains.

<Preparation of emulsion Em-1D>

In a manner similar to the preparation of the emulsion Em-1C, except that potassium hexachloroiridate was added in amount of $6.4\times10^{-7}$ mol per mol of silver nitrate 5 minutes before the end of the addition in the third step, obtained was a cubic emulsion in which 54% by number of the grains contains a rectangular intrafacial epitaxy junctioned in the neighborhood of the corners of a single (100) face of the grain. The obtained cubic emulsion was labeled Em-1D.

<Preparation of emulsion Em-1E>

In a manner similar to the preparation of the emulsion Em-1A, except that the pAg in each of the second and third steps is maintained at 8.5, obtained was an octagonal emulsion with an equivalent-sphere diameter of 0.50 μm and a dispersion coefficient of 8%. The obtained emulsion was labeled Em-1E.

<Preparation of emulsion Em-1F>

In a manner similar to the preparation of the emulsion Em-1E, except that potassium hexachloroiridate was added in amount of $6.4\times10^{-7}$ mol per mol of silver nitrate 5 minutes before the end of the addition in the third step, an octagonal emulsion was obtained. The obtained cubic emulsion was labeled Em-1F.

<Preparation of emulsion Em-1G>

In the preparation of the emulsion Em-1E, the pAg and pH were controlled to 6.5 and 5.4, respectively, 10 minutes after the addition of the sensitizing dyes, and 100 cc of an aqueous solution of 0.3 mol silver nitrate and 100 cc of an aqueous solution of 0.3 mol potassium bromide were added over one minute. Thereafter, following the same procedures as for the emulsion Em-1A, the resultant emulsion was subjected to the desalting step and redispersed at 50° C., pAg 9.0, and pH 6.4. The obtained emulsion consisted of an octagonal emulsion with an equivalent-sphere diameter of 0.5 μm and a dispersion coefficient of 8%. This emulsion was labeled Em-1G. In the emulsion Em-1G, a rectangular intrafacial epitaxy junctioned in the neighborhood of the corners of a single (111) face was observed in 35% by number of grains.

<Preparation of emulsion Em-1H>

In a manner similar to the preparation of the emulsion Em-1G, except that potassium hexachloroiridate was added in amount of $6.4\times10^{-7}$ mol per mol of silver nitrate 5 minutes before the end of the addition in the third step, obtained was a cubic emulsion in which 35% by number of the grains contains a rectangular intrafacial epitaxy junctioned in the neighborhood of the corners of a single (111) face of the grain. The obtained cubic emulsion was labeled Em-1H.

<Making of samples 1A to 1H>

The emulsions Em-1A to Em-1H thus prepared were heated up to 60° C. and added with $2.0\times10^{-3}$ mol of potassium thiocyanate, $4.1\times10^{-6}$ mol of chloroauric acid, $9.4\times10^{-6}$ mol of sodium thiocyanate, and $3.0\times10^{-6}$ of dimethylselenourea, as a selenium sensitizer. The resultant emulsions were ripened for 30 minutes, making colour sensitized samples 1A to 1H.

The colour sensitized emulsions prepared as described above were coated on TAC (triacetyl cellulose) supports under the coating condition below. Emulsion coating conditions (1) Emulsion layer Emulsions . . . each emulsion (the above colour sensitized emulsions)

(silver content $2.1\times10^{-2}$ mol/m$^2$)

Coupler represented by formula below ($1.5\times10^{-3}$ mol/m$^2$)

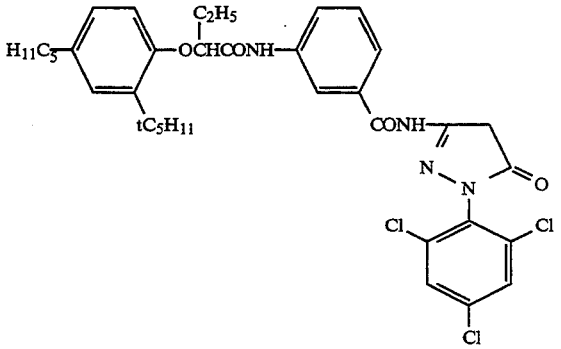

Tricresylphosphate (1.10 g/m$^2$)

Gelatin (2.3 g/m$^2$)

(2) Protective layer 2,4-dichloro-6-hydroxy-s-triazine sodium salt (0.08 g/m$^2$)

Gelatin (1.8 g/m$^2$)

These samples were left to stand at a temperature of 40° C. and a relative humidity of 70% for 14 hours, exposed through a YF filter (available from Fuji Photo Film Co., Ltd.) and a continuous wedge for 1/100 second, 1/10000 second, and 10 seconds, and subjected to the following color development.

| Process | (Processing method) Time | Temperature |
|---|---|---|
| Color development | 2 min. 45 sec. | 38° C. |
| Bleaching | 3 min. 00 sec. | 38° C. |
| Washing | 30 sec. | 24° C. |
| Fixing | 3 min. 00 sec. | 38° C. |
| Washing (1) | 30 sec. | 24° C. |
| Washing (2) | 30 sec. | 24° C. |
| Stabilization | 30 sec. | 38° C. |
| Drying | 4 min. 20 sec. | 55° C. |

The compositions of the individual processing solutions are shown below.

| | (g) |
|---|---|
| (Color developing solution) | |
| Diethylenetriaminepentaacetic acid | 1.0 |
| 1-hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-ethyl-N-β-hydroxylethylamino]-2-methylaniline sulfate | 4.5 |
| Water to make | 1.0 l |
| pH | 10.05 |
| (Bleaching solution) | |
| Ferric ammonium ethylenediamine-tetraacetate trihydrate | 100.0 |
| Disodium ethylenediaminetetraacetate | 10.0 |
| 3-mercapto-1,2,4-triazole | 0.08 |
| Ammonium bromide | 140.0 |
| Ammonium nitrate | 30.0 |
| Ammonia water (27%) | 6.5 ml |
| Water to make | 1.0 l |
| pH | 6.0 |
| (Fixing solution) | |
| Disodium ethylenediaminetetraacetate | 0.5 |
| Ammonium sulfite | 20.0 |
| Ammonium thiosulfate aqueous solution (700 g/l) | 290.0 ml |
| Water to make | 1.0 l |
| pH | 6.7 |
| (Stabilizing solution) | |
| Sodium p-toluenesulfinate | 0.03 |
| Polyoxyethylene-p-monononylphenylether (average polymerization degree 10) | 0.2 |
| Disodium ethylenediaminetetraacetate | 0.05 |
| 1,2,4-triazole | 1.3 |
| 1,4-bis(1,2,4-triazole-1-ylmethyl)piperazine | 0.75 |
| Water to make | 1.0 l |
| pH | 8.5 |

Density measurement was performed for each processed sample by using a green filter, and the value of the sensitivity and the fog of each sample was respectively obtained from the measurement result. Note that the sensitivity was represented by a relative value of the reciprocal of an exposure amount by which a density of fog +0.2 was given. The obtained results are summarized in Table 1 below.

TABLE 1

| Sample | Grain shape | Epitaxy | Iridium compound | Sensitivity at 1/100 sec. exposure | Sensitivity at 1/10000 sec. exposure | Sensitivity at 10 sec. exposure | Remarks |
|---|---|---|---|---|---|---|---|
| 1A | Cube | None | None | 100 | 77 | 56 | Comparative example |
| 1B | Cube | None | Formed | 87 | 79 | 55 | Comparative example |
| 1C | Cube | Formed | None | 185 | 121 | 101 | Comparative example |
| 1D | Cube | Formed | Formed | 185 | 181 | 183 | Present invention |
| 1E | Octahedron | None | None | 68 | 31 | 12 | Comparative example |
| 1F | Octahedron | None | Formed | 51 | 28 | 15 | Comparative example |
| 1G | Octahedron | Formed | None | 86 | 34 | 21 | Comparative example |
| 1H | Octahedron | Formed | Formed | 88 | 81 | 85 | Present invention |

As can be understood from Table 1, the iridium compound, as added, relatively improves the reciprocity law; however, the sensitivity at an exposure time of 1/100 second significantly deteriorates. In contrast, the emulsion in which an intrafacial epitaxy is formed exhibits a high sensitivity at an exposure time of 1/100 second; however the sensitivity at a high or low illumination intensity remains low. In the case where the addition of the iridium compound, and the intrafacial epitaxy are combined, not only the sensitivity at an exposure time of 1/100 is kept up, but also the reciprocity law can be improved to a level at which there is no reciprocity law failure. Further, the octagonal emulsion and the cubic emulsion exhibit the same type of effect; however the effect of the cubic emulsion is more significant than that of the octagonal type.

Example 2

The formation timing dependency of an intrafacial epitaxy will be described.

<Preparation of emulsion Em-2A>

An aqueous silver nitrate solution and an aqueous solution mixture of potassium bromide and potassium iodide, that contained 1 mol % of iodide, were added to an aqueous gelatin solution at pH 4.5 and 40° C. by a controlled double-jet method of pAg 7.5. The amount of silver nitrate was 200 g. The resultant emulsion was subjected to a normal desalting step and redispersed at 50° C., pAg 8.0, and pH 6.4. The obtained emulsion consisted of a tetradecahedral fine grain emulsion with an equivalent-sphere diameter of 0.05 μm. This emulsion was labeled Em-2A. The yield was 1,180 g.

<Preparation of colour sensitized emulsion Em-2B>

An aqueous silver nitrate solution and an aqueous solution mixture of potassium bromide and potassium iodide were added at a temperature of 76° C. to an aqueous gelatin solution at pH 6 and 76° C. by a controlled double-jet method of pAg 7.0. This addition was divisionally performed by two stages, the first stage for 20 minutes, and the second stage for 100 minutes. 10 g and 160 g of silver nitrate were consumed in the first and second stages, respectively. The iodide content of the halogen solution was 0 mol % and 1 mol % in the first and second stages, respectively, and the average iodide content of grains was 0.94 mol %. After the addition of the second stage, the pAg was controlled to 9.0, 30 g of the emulsion Em-1A were added to the resultant emulsion, and the emulsion was ripened for 30 minutes. The emulsion was then subjected to the normal desalting step and redispersed at 50° C., pAg 8.6, and pH 6.4. The obtained emulsion consisted of a cubic emulsion with an equivalent-sphere diameter of 0.70 μm and a dispersion coefficient of 14%.

The emulsion thus prepared was heated up to 60° C., and added with $1.2\times10^{-6}$ mol of potassium hexachloroiridate per mol of silver. The emulsion was further added with $2.1\times10^{-4}$ mol, $6.5\times10^{-5}$ mol, and $4.1\times10^{-6}$ mol of the sensitizing dyes 1-1, 1-2, and 1-3, respectively, and further added with $1.5\times10^{-3}$ mol of potassium thiocyanate, $1\times10^{-6}$ mol of chloroauric acid, $3.2\times10^{-6}$ mol of sodium thiosulfate, and $1.1\times10^{-6}$ mol of dimethylselenourea, as a selenium sensitizer, and ripened for 45 minutes, preparing a colour sensitized emulsion Em-2B. Intrafacial epitaxies were observed in 38% of grains.

<Preparation of colour sensitized emulsion Em-2C>

Following the same procedures as for the colour sensitized emulsion Em-2B, the additions up to the second stage were performed. The resultant emulsion was subjected to the desalting step and redispersed at 50° C., pAg 8.6, and pH 6.4, preparing a cubic emulsion with an equivalent-sphere diameter of 0.70 μm and a dispersion coefficient of 14%.

The emulsion thus prepared was heated up to 60° C., and added with $1.2\times10^{-6}$ mol of potassium hexachloroiridate per mol of silver. The emulsion was further added with $2.1\times10^{-4}$ mol, $6.5\times10^{-5}$ mol, and $4.1\times10^{-6}$ mol of the sensitizing dyes 1-1, 1-2, and 1-3, respectively, and ripened for 15 minutes. After the pAg was controlled to 9.0, the resultant emulsion was added with 30 g of the emulsion Em-2A and ripened for 30 minutes. The emulsion was further added with $1.5\times10^{-3}$ mol of potassium thiocyanate, $1\times10^{-6}$ mol of chloroauric acid, $3.2\times10^{-6}$ mol of sodium thiosulfate, and $1.1\times10^{-6}$ mol of dimethylselenourea, as a selenium sensitizer, and ripened for 45 minutes, preparing a colour sensitized emulsion Em-2C. Intrafacial epitaxies were observed in 56% of grains.

<Preparation of colour sensitized emulsion Em-2D>

Following the same procedures as for the colour sensitized emulsion Em-2C, a cubic emulsion with an equivalent-sphere diameter of 0.7 μm and a dispersion coefficient of 14% was prepared through grain formation, desalting, and redispersion at 50° C., pAg 8.6, and pH 6.4.

The emulsion thus prepared was heated up to 60° C., and added with $1.2\times10^{-6}$ mol of potassium hexachloroiridate per mol of silver. The emulsion was further added with $2.1\times10^{-4}$ mol, $6.5\times10^{-5}$ mol, and $4.1\times10^{-6}$ mol of the sensitizing dyes 1-1, 1-2, and 1-3, respectively, and further added with $1.5\times10^{-3}$ mol of potassium thiocyanate, $1\times10^{-6}$ mol of chloroauric acid, $3.2\times10^{-6}$ mol of sodium thiosulfate, and $1.1\times10^{-6}$ mol of dimethylselenourea, as a selenium sensitizer, and ripened for 45 minutes. Thereafter, the pAg was controlled to 9.3, and the resultant emulsion was added with 30 g of the emulsion Em-2A and ripened for 15 minutes, preparing a colour sensitized emulsion Em-2D. Intrafacial epitaxies were observed in 73% of grains.

<Preparation of colour sensitized emulsion Em-2E>

Following the same procedures as for the colour sensitized emulsion Em-2C, a cubic emulsion with an equivalent-sphere diameter of 0.7 μm and a dispersion coefficient of 14% was prepared through grain formation, desalting, and redispersion at 50° C., pAg 8.6, and pH 6.4.

The emulsion thus prepared was heated up to 60° C., and added with $1.2\times10^{-6}$ mol of pursue hexachloroiridate per mol of silver. The emulsion was further added with $2.1\times10^{-4}$ mol, $6.5\times10^{-5}$ mol, and $4.1\times10^{-6}$ mol of the sensitizing dyes 1-1, 1-2, and 1-3, respectively, and further added with $1.5\times10^{-3}$ mol of potassium thiocyanate, $1\times10^{-6}$ mol of chloroauric acid, $3.2\times10^{-6}$ mol of sodium thiosulfate, and $1.1\times10^{-6}$ mol of dimethylselenourea, as a selenium sensitizer, and ripened for 45 minutes, preparing a colour sensitized emulsion Em-2E.

The emulsions thus prepared were subjected to coating, exposure, development, and measurements following the same procedures as in Example 1, obtaining the sensitivity and the fog of each emulsion. The results are summarized in Table 2 below.

TABLE 2

| Sample | Epitaxial formation timing | Sensitivity at 1/100 sec. exposure | Sensitivity at 1/10000 sec. exposure | Sensitivity at 10 sec. exposure | Remarks |
|---|---|---|---|---|---|
| 2B | Immediately after | 167 | 147 | 138 | Present invention |

TABLE 2-continued

| Sample | Epitaxial formation timing | Sensitivity at 1/100 sec. exposure | Sensitivity at 1/10000 sec. exposure | Sensitivity at 10 sec. exposure | Remarks |
|---|---|---|---|---|---|
| | grain formation | | | | |
| 2C | Immediately before chemical sensitization | 188 | 180 | 181 | Present invention |
| 2D | After chemical sensitization | 175 | 171 | 170 | Present invention |
| 2E | Not formed | 100 | 78 | 54 | Comparative example |

As can be understood from Table 2, regardless of the time of formation of an intrafacial epitaxy, the reciprocity law failure can be improved by combining the iridium compound and the intrafacial epitaxy. Further, the improvement effect of reciprocity law is particularly significant in the case where silver halide grains are added after addition of the iridium compound. Example 3

The iodide content dependency of a substrate to which an intrafacial epitaxy is junctioned will be described.

<Preparation of colour sensitized emulsion Em-3A to Em-3F>

An aqueous solution containing 20 g of silver nitrate and an aqueous potassium bromide solution were added at a temperature of 76° C. to an aqueous gelatin solution at pH 6 and 76° C. over 13 minutes by a controlled double-jet method of pAg 7.0. In addition, 640 cc of an aqueous solution containing 160 g of silver nitrate were added to the resultant solution over 80 minutes while the flow rate was raised from 5.3 cc/min by 0.066 cc per minute with the pAg controlled to 6.0 by an aqueous potassium bromide solution. Simultaneously, an aqueous solution mixture of potassium bromide and potassium iodide, containing 30 mol % of iodide, was added such that the ratio to silver nitrate was maintained constant at any instant.

The resultant emulsion was subjected to a desalting step and redispersed at 50° C., pAg 8.4, and pH 6.4. The obtained emulsions consisted in cubic emulsions Em-3A to Em-3F with an equivalent-sphere diameter of 0.43 μm, a dispersion coefficient of 8%, and different silver iodide contents.

The emulsions thus prepared were heated up to 60° C., and added with $4.5\times10^{-7}$ mol of potassium hexachloroiridate per mol of silver. The emulsion was further added with $6.8\times10^{-4}$ mol, $2.0\times10^{-4}$ mol, and $1.5\times10^{-5}$ mol of the sensitizing dyes 1-1, 1-2, and 1-3, respectively. Chemical sensitization was performed optimally for each emulsion by adding potassium thiocyanate, chloroauric acid, sodium thiosulfate, and dimethylselenourea. Thereafter, $2\times10^{-3}$ mol of a compound F-12 (to be presented later) was added to each emulsion, controlling the pAg to 9.25. The optimal chemical sensitization means chemical sensitization by which the highest sensitivity is obtained when exposure is performed for 1/100 second. The emulsion was added with an aqueous solution containing 3 g of silver nitrate and an aqueous potassium bromide solution in an equal molar quantity of the silver nitrate over 15 seconds and ripened for 30 minutes, preparing emulsions Em-3A to Em-3F.

Following the same procedures as in Example 1, coating, exposure, development, and measurements were performed for the resultant colour sensitized emulsions Em-3A to Em-3F having different iodide contents, obtaining the sensitivity and the fog of each emulsion. These results are summarized in Table 3 below.

TABLE 3

| Sample | Iodide content (mol %) | Sensitivity at 1/100 sec. exposure | Sensitivity at 1/10000 sec. exposure | Sensitivity at 10 sec. exposure | Remarks |
|---|---|---|---|---|---|
| 3A | 0 | 100 | 97 | 98 | Present invention |
| 3B | 1 | 113 | 110 | 110 | Present invention |
| 3C | 2 | 121 | 121 | 119 | Present invention |
| 3D | 4 | 107 | 101 | 100 | Present invention |
| 3E | 6 | 78 | 71 | 68 | Present invention |
| 3F | 10 | 47 | 40 | 33 | Present invention |

As can be understood from Table 3, the emulsion of the present invention exhibits an effect of the reciprocity law improvement for any silver halide content; however the improvement effect is mostly significant when the silver iodide content is less than 5 mol %.

Example 4

Effects of coating silver halide emulsions of the present invention in multiple layers will be described below.

Multiple layers having the compositions presented below were coated on an undercoated triacetylcellulose film support to make a sample 4-1 as a multilayered color photographing material. (Compositions of light-sensitive layers)

The main materials used in the individual layers are classified as follows.

ExC: Cyan coupler
ExM: Magenta coupler
ExY: Yellow coupler
ExS: Sensitizing dye
UV: Ultraviolet absorbent
HBS: High-boiling organic solvent
H: Gelatin hardener The number corresponding to each component indicates the coating amount in units of g/m². The coating amount of a silver halide is represented by the amount of silver. The coating amount of each sensitizing dye is represented in units of mols per mol of a silver halide in the same layer.

| 1st layer (Antihalation layer) | |
|---|---|
| Black colloidal silver | silver 0.18 |
| Gelatin | 1.40 |

-continued

| | |
|---|---|
| ExM-1 | 0.18 |
| ExF-1 | $2.0 \times 10^{-3}$ |
| HBS-1 | 0.20 |
| 2nd layer (Interlayer) | |
| Emulsion G | silver 0.065 |
| 2,5-di-t-pentadecylhydroquinone | 0.18 |
| ExC-2 | 0.020 |
| UV-1 | 0.060 |
| UV-2 | 0.080 |
| UV-3 | 0.10 |
| HBS-1 | 0.10 |
| HBS-2 | 0.020 |
| Gelatin | 1.04 |
| 3rd layer (Low-speed red-sensitive emulsion layer) | |
| Emulsion A | silver 0.25 |
| Emulsion C | silver 0.25 |
| ExS-1 | $4.5 \times 10^{-4}$ |
| ExS-2 | $1.5 \times 10^{-5}$ |
| ExS-3 | $4.5 \times 10^{-4}$ |
| ExC-1 | 0.17 |
| ExC-3 | 0.030 |
| ExC-4 | 0.10 |
| ExC-5 | 0.005 |
| ExC-7 | 0.0050 |
| ExC-8 | 0.020 |
| Cpd-2 | 0.025 |
| HBS-1 | 0.10 |
| Gelatin | 0.87 |
| 4th layer (Medium-speed red-sensitive emulsion layer) | |
| Emulsion D | silver 0.80 |
| ExS-1 | $3.0 \times 10^{-4}$ |
| ExS-2 | $1.2 \times 10^{-5}$ |
| ExS-3 | $4.0 \times 10^{-4}$ |
| ExC-1 | 0.15 |
| ExC-2 | 0.060 |
| ExC-3 | 0.11 |
| ExC-4 | 0.090 |
| ExC-7 | 0.0010 |
| ExC-8 | 0.025 |
| Cpd-2 | 0.023 |
| HBS-1 | 0.10 |
| Gelatin | 0.75 |
| 5th layer (High-speed red-sensitive emulsion layer) | |
| Emulsion E | silver 1.40 |
| ExS-1 | $2.0 \times 10^{-4}$ |
| ExS-2 | $1.0 \times 10^{-4}$ |
| ExS-3 | $3.0 \times 10^{-4}$ |
| ExC-1 | 0.095 |
| ExC-3 | 0.040 |
| ExC-6 | 0.020 |
| ExC-8 | 0.007 |
| Cpd-2 | 0.050 |
| HBS-1 | 0.22 |
| HBS-2 | 0.10 |
| Gelatin | 1.20 |
| 6th layer (Interlayer) | |
| Cpd-1 | 0.10 |
| HBS-1 | 0.50 |
| Gelatin | 1.10 |
| 7th layer (Low-speed green-sensitive emulsion layer) | |
| Emulsion A | silver 0.2 |
| Emulsion B | silver 0.2 |
| ExS-4 | $4.0 \times 10^{-4}$ |
| ExS-5 | $1.8 \times 10^{-4}$ |
| ExS-6 | $6.5 \times 10^{-4}$ |
| ExM-1 | 0.010 |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |
| 8th layer (Medium-speed green-sensitive emulsion layer) | |

-continued

| | |
|---|---|
| Emulsion D | silver 0.80 |
| ExS-4 | $2.0 \times 10^{-5}$ |
| ExS-5 | $1.4 \times 10^{-4}$ |
| ExS-6 | $5.4 \times 10^{-4}$ |
| ExM-2 | 0.16 |
| ExM-3 | 0.045 |
| ExY-1 | 0.01 |
| ExY-5 | 0.030 |
| HBS-1 | 0.16 |
| HBS-3 | $8.0 \times 10^{-3}$ |
| Gelatin | 0.90 |
| 9th layer (High-speed green-sensitive emulsion layer) | |
| Emulsion E | silver 1.25 |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.015 |
| ExM-4 | 0.040 |
| ExM-5 | 0.019 |
| Cpd-3 | 0.020 |
| HBS-1 | 0.25 |
| HBS-2 | 0.10 |
| Gelatin | 1.20 |
| 10th layer (Yellow filter layer) | |
| Yellow colloidal silver | silver 0.010 |
| Cpd-1 | 0.16 |
| HBS-1 | 0.60 |
| Gelatin | 0.60 |
| 11th layer (Low-speed blue-sensitive emulsion layer) | |
| Emulsion C | silver 0.25 |
| Emulsion D | silver 0.4 |
| ExS-7 | $8.0 \times 10^{-4}$ |
| ExY-1 | 0.030 |
| ExY-2 | 0.55 |
| ExY-3 | 0.25 |
| ExY-4 | 0.020 |
| ExC-7 | 0.01 |
| HBS-1 | 0.35 |
| Gelatin | 1.30 |
| 12th layer (Medium-speed blue-sensitive emulsion layer) | |
| Emulsion F | silver 1.38 |
| ExS-7 | $3.0 \times 10^{-4}$ |
| ExY-2 | 0.10 |
| ExY-3 | 0.10 |
| HBS-1 | 0.070 |
| Gelatin | 0.86 |
| 13th layer (1st protective layer) | |
| Emulsion G | silver 0.20 |
| UV-4 | 0.11 |
| UV-5 | 0.17 |
| HBS-1 | $5.0 \times 10^{-2}$ |
| Gelatin | 1.00 |
| 14th layer (2nd protective layer) | |
| H-1 | 0.40 |
| B-1 (diameter 1.7 μm) | $5.0 \times 10^{-2}$ |
| B-2 (diameter 1.7 μm) | 0.10 |
| B-3 | 0.10 |
| S-1 | 0.20 |
| Gelatin | 1.20 |

In addition to the above components, to improve storage stability, processibility, a resistance to pressure, antiseptic and mildewproofing properties, antistatic properties, and coating properties, the individual layers contained W-1 to W-3, B-4 to B-6, F-1 to F-17, iron salt, lead salt, gold salt, platinum salt, iridium salt, and rhodium salt.

The compound represented by the symbols were described below, and the emulsions A to G used in the above compositions were those listed in Table 4 below.

| | Average AgI content (%) | Average grain size (μm) | Variation coefficient (%) according to grain size | Diameter/ thickness ratio | Silver amount ratio [core/ intermediate/ shell] | (AgI content) | Grain structure/ shape |
|---|---|---|---|---|---|---|---|
| Emulsion A | 2 | 0.55 | 25 | 7 | — | — | Uniform structure tabular grain |
| Emulsion B | 4.5 | 0.65 | 25 | 6 | [12/59/29] | (0/11/8) | Triple structure tabular grain |
| Emulsion C | 3 | 0.45 | 25 | 7 | [10/60/30] | (0/1/8) | Triple structure tabular grain |
| Emulsion D | 2.8 | 0.8 | 18 | 6 | [14/56/30] | (0.2/1/7.5) | Triple structure tabular grain |
| Emulsion E | 2.3 | 1.1 | 16 | 6 | [6/64/30] | (0.2/1/5.5) | Triple structure tabular grain |
| Emulsion F | 13.6 | 1.75 | 26 | 3 | [1/2] | (41/0) | Double structure plate-like grain |
| Emulsion G | 1 | 0.07 | 15 | 1 | — | — | Uniform structure fine grain |

In Table 4, (1) The emulsions A to F were subjected to reduction sensitization during grain preparation by using thiourea dioxide and thiosulfonic acid in accordance with the Examples in JP-A-2-191938.

(2) The emulsions A to F were subjected to gold sensitization, sulfur sensitization, and selenium sensitization in the presence of the spectral sensitizing dyes described in the individual light-sensitive layers and sodium thiocyanate in accordance with the Examples in JP-A-3-237450.

(3) The preparation of tabular grains was performed by using low-molecular weight gelatin in accordance with the Examples in JP-A-1-158426.

(4) Dislocation lines as described in JP-A-3-237450 were observed in tabular grains and regular crystal grains having a grain structure when a high-voltage electron microscope was used.

ExC-1

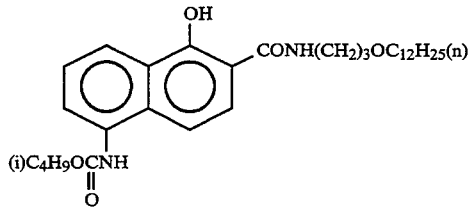

ExC-2

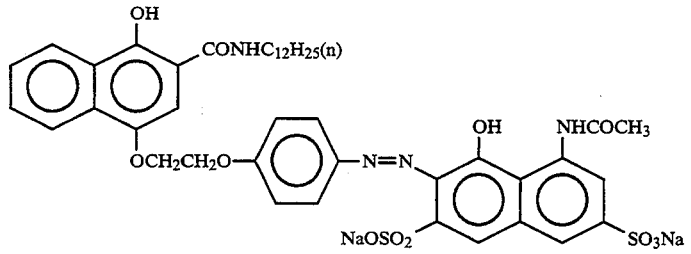

ExC-3

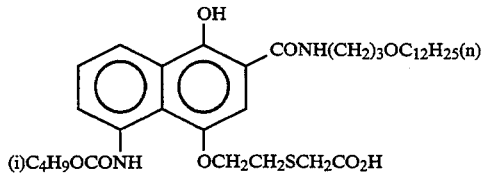

ExC-4

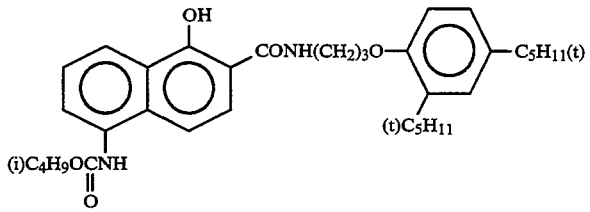

-continued
ExC-5
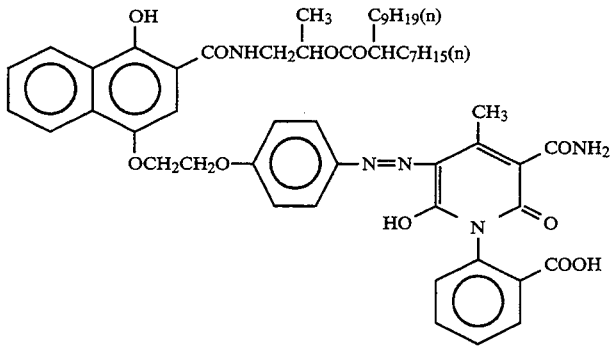
ExC-6
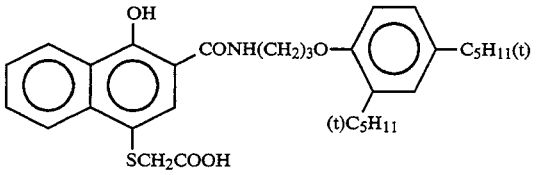
ExC-7
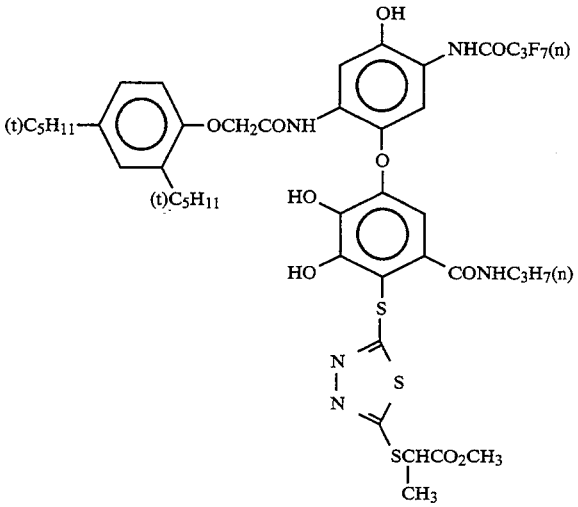
ExC-8
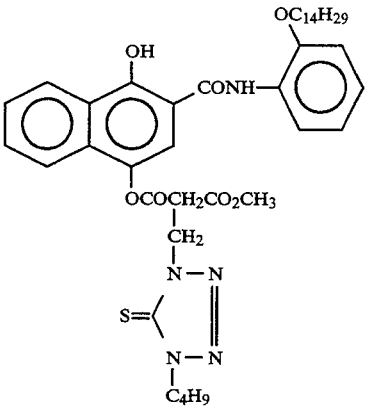

-continued
ExM-1
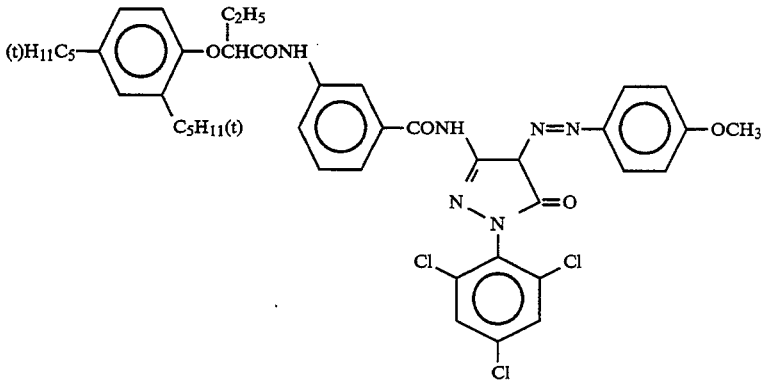
ExM-2
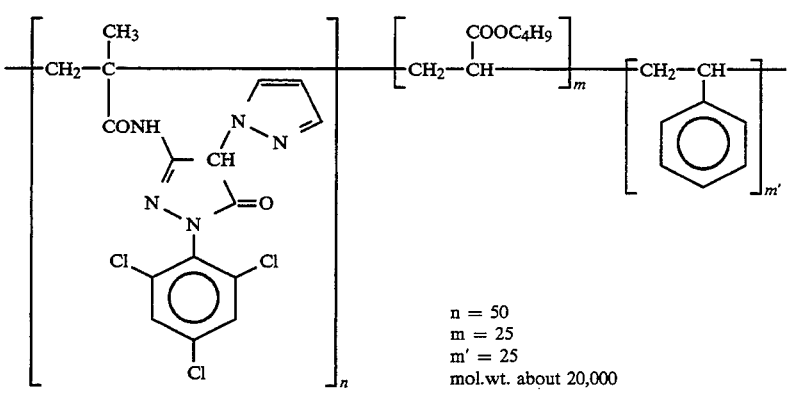
n = 50
m = 25
m' = 25
mol.wt. about 20,000
ExM-3
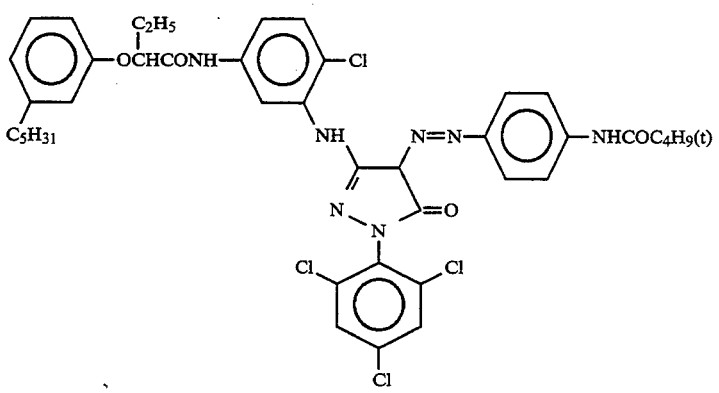
ExM-4
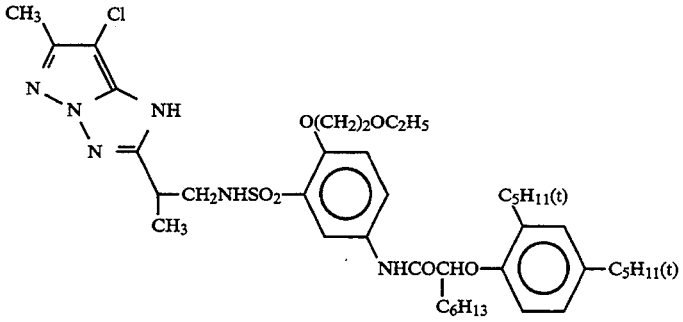

-continued
ExM-5
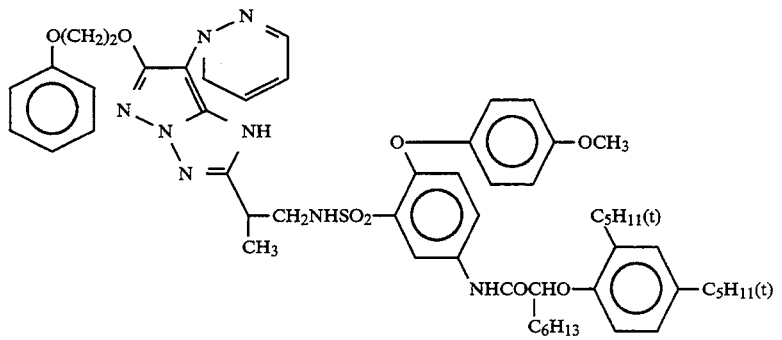
ExY-1
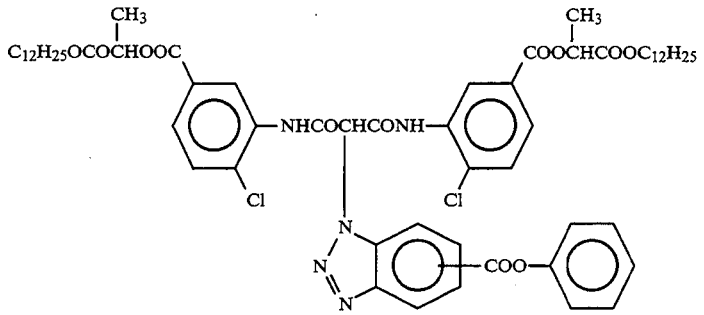
ExY-2
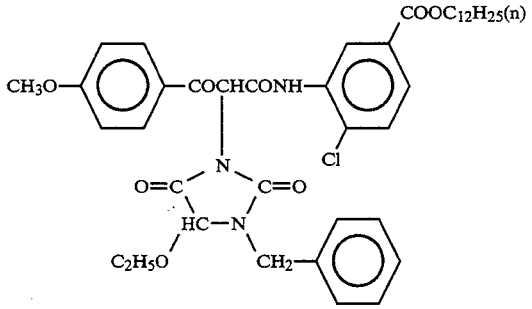
ExY-3
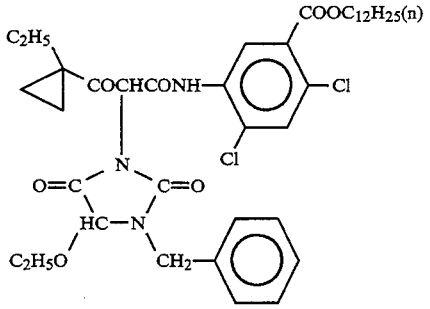
ExY-4
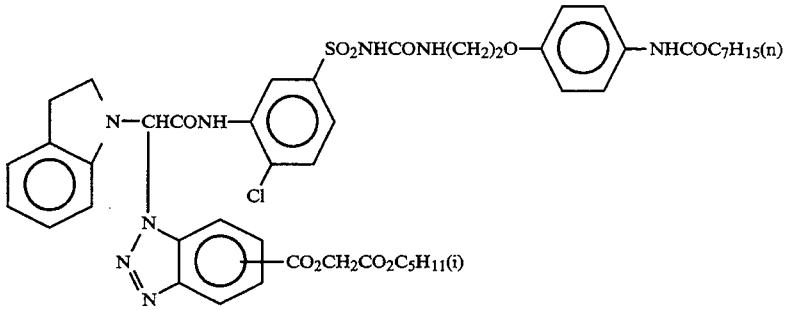

-continued
ExY-5
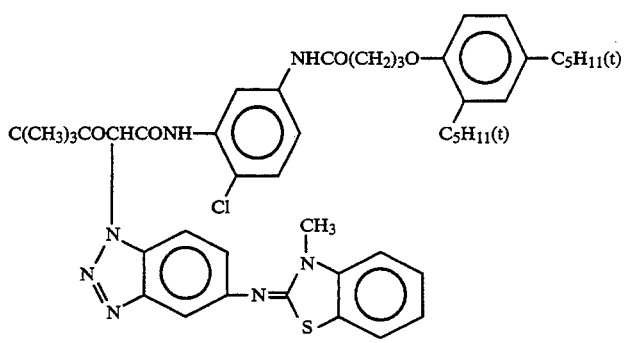
ExF-1
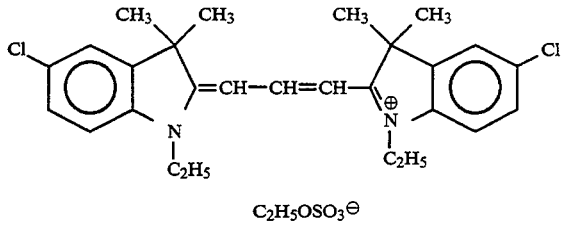
Cpd-1
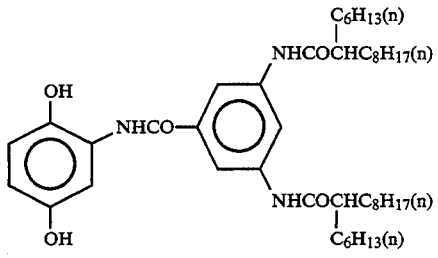
Cpd-2
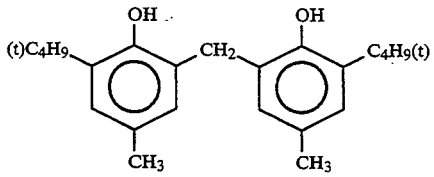
Cpd-3
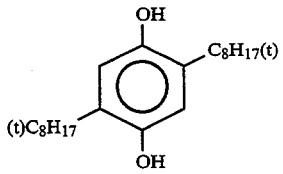
UV-1
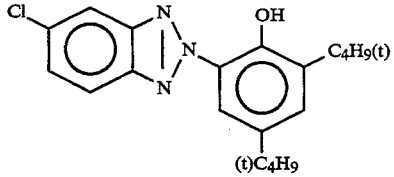
UV-2
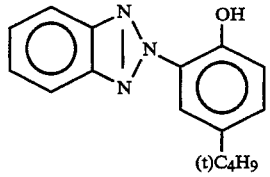

-continued
UV-3
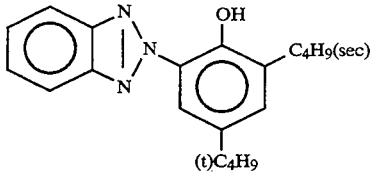
UV-4
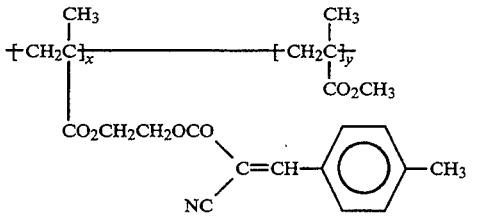
x:y = 70:30 (wt%)
UV-5
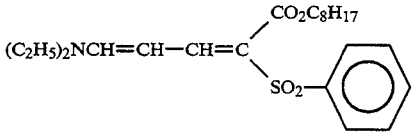
tricresylphosphate HBS-1
di-n-butylphtalate HBS-2
HBS-3
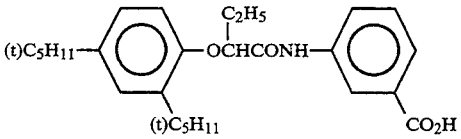
ExS-1
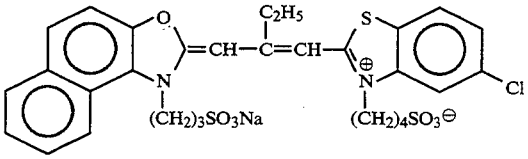
ExS-2
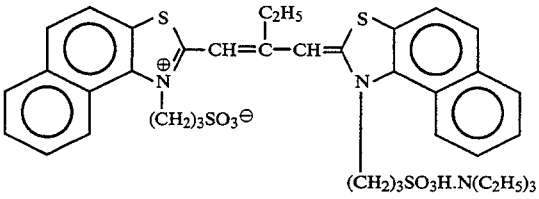
ExS-3
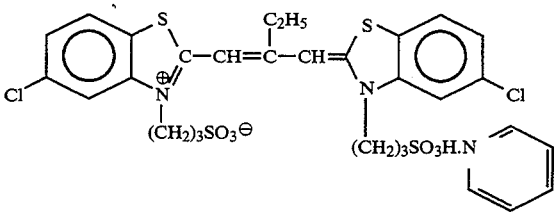
ExS-4
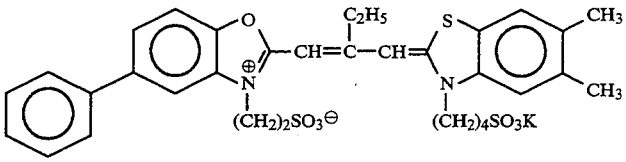

-continued
ExS-5
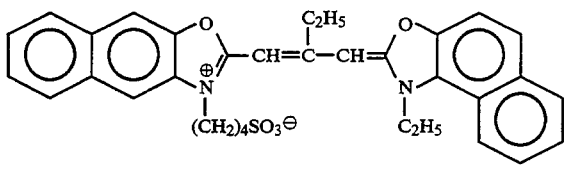
ExS-6
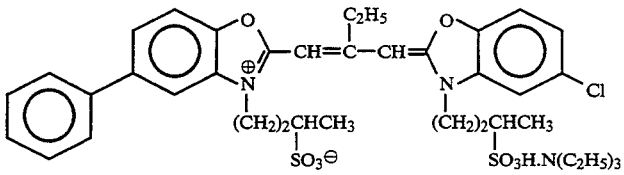
ExS-7
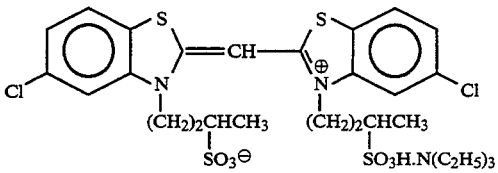
S-1
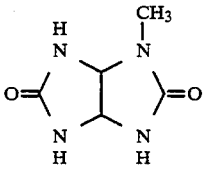
H-1
$CH_2{=}CH{-}SO_2{-}CH_2{-}CONH{-}CH_2$
$CH_2{=}CH{-}SO_2{-}CH_2{-}CONH{-}CH_2$
B-1
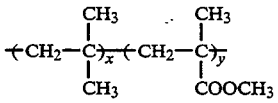
x/y = 10/90
B-2
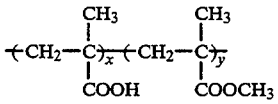
x/y = 40/60
B-3
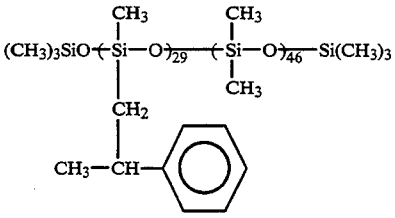
B-4
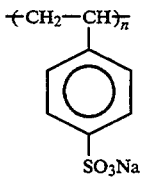
B-5
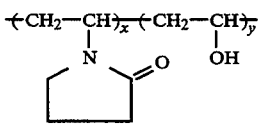
x/y = 70/30

-continued
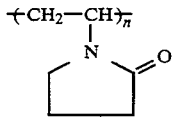
(mol. wt. about 10,000) B-6
$C_8F_{17}SO_2NHCH_2CH_2CH_2OCH_2CH_2\overset{\oplus}{N}(CH_3)_3$ W-1
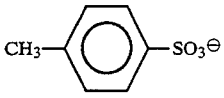
W-2
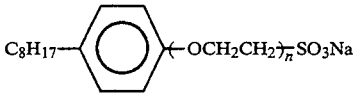
n = 2–4
W-3
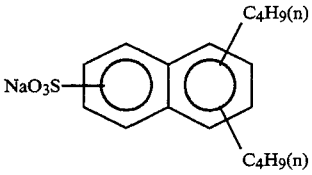
F-1
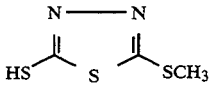
F-2
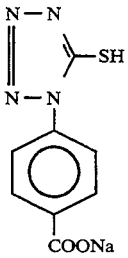
F-3
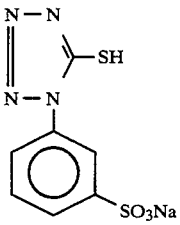
F-4
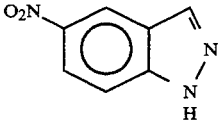
F-5
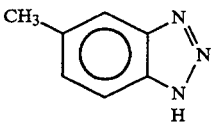
F-6
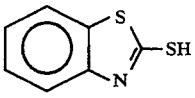

-continued
F-7
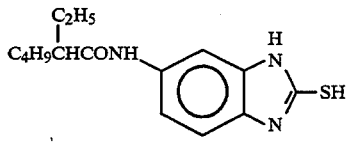
F-8
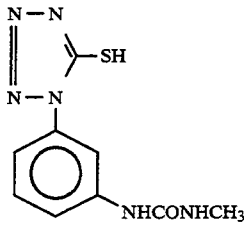
F-9
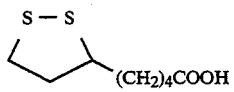
F-10
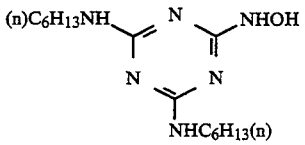
F-11
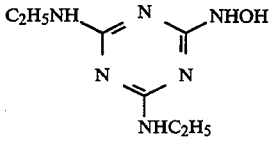
F-12
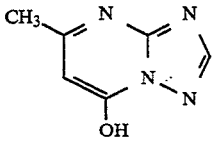
F-13
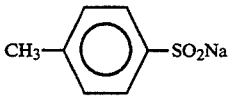
F-14
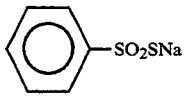
F-15
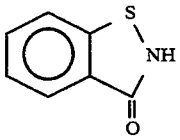
F-16
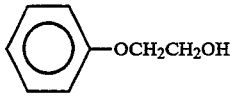
F-17
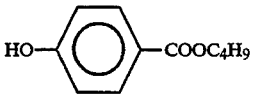

In addition, four types of emulsions as listed in Table 5 below were prepared following the same procedures as for the emulsions Em-2C of Example 2.

TABLE 5

| Sample | Average grain size (μm) | Epitaxy | Iridium compound | Remarks |
|---|---|---|---|---|
| Emulsion 4A | 0.25 | Formed | Formed | Present invention |
| Emulsion 4B | 0.45 | None | None | Comparative example |
| Emulsion 4C | 0.45 | Formed | None | Comparative example |
| Emulsion 4D | 0.45 | Formed | Formed | Present invention |

A sample 4-2 was prepared by, in the layer 7, replacing the emulsion A with the emulsion 4B, and the emulsion B with the emulsion 4A, and reducing the amount of silver applied by 30%. A sample 4-3 was prepared by replacing the emulsion 4B with the emulsion 4C in the layer 7 in the preparation of the sample 4-2, and a sample 4-4 was prepared by replacing the emulsion 4B with the emulsion 4D of the present invention.

These samples were let stand for 14 hours at a temperature of 40° C., and a relative humidity of 70%, and then exposed for 1/100 second by white light so as to perform a color development process of the Example 1, except that the color developing time was 3 min. 15 sec.

By use of a green filter, the density measurement was performed, and the relative sensitivity was obtained from a reciprocal of an exposure amount required to impart an optical density of 2.5. The measurement of the graininess was performed by the method described in "The Theory of Photographic Process", page 619 published by Macmillan, after a uniform exposure imparting an optical density of 2.5 and a development.

The results were as shown in Table 6.

TABLE 6

| Sample | 7th layer Emulsions used | 7th layer Coating silver amounts | Sensitivity at 1/100 sec. exposure | Sensitivity at 1/10000 sec. exposure | Sensitivity at 10 sec. exposure | Granularilty at 1/100 sec. exposure | Remarks |
|---|---|---|---|---|---|---|---|
| Sample 4-1 | Emulsion A/ Emulsion B | 0.20/ 0.20 | 100 | 76 | 55 | 100 | Comparative example |
| Sample 4-2 | Emulsion 4B/ Emulsion 4A | 0.14/ 0.14 | 78 | 52 | 40 | 78 | Comparative example |
| Sample 4-3 | Emulsion 4C/ Emulsion 4A | 0.14/ | 103 | 77 | 57 | 81 | Comparative example |
| Sample 4-4 | Emulsion 4D/ Emulsion 4A | 0.14/ 0.14 | 105 | 103 | 100 | 80 | Present invention |

As can be understood from Table 6, the silver halide photographic light-sensitive material of the present invention containing a cubic emulsion having an iridium compound and an intrafacial epitaxy has a more improved reciprocal law failure than the conventional tabular or cubic emulsion, and exhibits a high sensitivity for both high and low illumination intensity. The sample 4-1 of the comparative example and the sample 4-4 containing the silver halide emulsion of the present invention have substantially the same gradation, and the emulsion of the invention exhibits an excellent image quality for a small amount of silver applied.

What is claimed is:

1. A silver halide photographic emulsion comprising silver halide grains, to which an iridium compound was added during a preparation process, wherein each grain has a major plane having corners, with a neighborhood of the corners being present, wherein at least 5% by number of said silver halide grains have at least one intrafacial epitaxy limited in the neighborhood of the corners of the major plane of the grain, and a thickness of said epitaxy is 0.1 μm or less, and wherein said epitaxy has a surface index which is the same as that of the major plane, and epitaxies form only in a position which is limited to the neighborhood of the corners of the major plane of the grain.

2. The silver halide photographic emulsion according to claim 1, wherein the intrafacial epitaxy of each of said silver halide grains is present in a (100) face of the grain.

3. The silver halide photographic emulsion according to claim 1 or 2, wherein said silver halide grains have a silver iodide content of less than 5 mol %.

4. The silver halide photographic emulsion according to claim 1 or 2, wherein said silver halide grains have a silver iodide content of 0.5 mol % to less than 5 mol %.

5. The silver halide photographic emulsion according to claim 1, wherein each of said silver halide grains and said intrafacial epitaxy is silver bromoiodide containing less than 5 mol % of a silver iodide.

6. The silver halide photographic emulsion according to claim 1, wherein said silver halide grains have been subjected to selenium sensitization.

7. A method of preparing the silver halide photographic emulsion according to claim 1, wherein silver halide fine grains are added in the presence of an iridium compound.

8. A method of preparing the silver halide photographic emulsion according to claim 1, wherein silver halide fine grains are added in the presence of an iridium compound immediately before chemical sensitization, or during chemical sensitization, or after chemical sensitization.

9. The method of preparing the silver halide photographic emulsion according to claim 8, wherein the silver halide emulsion has been subjected to selenium sensitization.

* * * * *